US010789964B2

(12) United States Patent
Liu et al.

(10) Patent No.: US 10,789,964 B2
(45) Date of Patent: Sep. 29, 2020

(54) DYNAMIC BIT ALLOCATION METHODS AND DEVICES FOR AUDIO SIGNAL

(71) Applicant: HUAWEI TECHNOLOGIES CO., LTD., Shenzhen, Guangdong (CN)

(72) Inventors: Zexin Liu, Beijing (CN); Lei Miao, Beijing (CN); Chen Hu, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 57 days.

(21) Appl. No.: 16/167,281

(22) Filed: Oct. 22, 2018

(65) Prior Publication Data

US 2019/0057706 A1 Feb. 21, 2019

Related U.S. Application Data

(63) Continuation of application No. 14/984,703, filed on Dec. 30, 2015, now Pat. No. 10,152,981, which is a (Continued)

(30) Foreign Application Priority Data

Jul. 1, 2013 (CN) ..... 2013 1 0271015

(51) Int. Cl.
*G10L 19/02* (2013.01)
*G10L 19/002* (2013.01)
*G10L 19/032* (2013.01)

(52) U.S. Cl.
CPC ..... *G10L 19/0204* (2013.01); *G10L 19/002* (2013.01); *G10L 19/032* (2013.01)

(58) Field of Classification Search
CPC .. G10L 19/0204; G10L 19/002; G10L 19/032
See application file for complete search history.

(56) References Cited

U.S. PATENT DOCUMENTS 5,235,671 A 8/1993 Mazor
5,479,561 A 12/1995 Kim
(Continued)

FOREIGN PATENT DOCUMENTS

CN 101105940 A 1/2008
CN 101202046 A 6/2008
(Continued)

OTHER PUBLICATIONS

Shen et al., "A Progressive Algorithm for Perceptual Coding of Digital Audio Signals," In Conference Record of the Thirty-Third Asilomar Conference on Signals, Systems, and Computers (Cat. No. CH37020). IEEE, Oct. 1999, p. 1105-1109.
(Continued)

*Primary Examiner* — Shaun Roberts
(74) *Attorney, Agent, or Firm* — Fish & Richardson P.C.

(57) ABSTRACT

Embodiments of the present disclosure provide signal encoding and decoding methods and devices. The method includes: determining, a quantity k of subbands to be encoded, where i is a positive number, and k is a positive integer; selecting, according to quantized envelopes of all subbands, k subbands from all the subbands, or selecting k subbands from all subbands according to a psychoacoustic model; and performing a first-time encoding operation on spectral coefficients of the k subbands. In some embodiments of the present disclosure, the quantity k of subbands to be encoded is determined according to the quantity of available bits and the first saturation threshold, and encoding is performed on the k subbands that are selected from all the subbands, instead of on an entire frequency band.

17 Claims, 4 Drawing Sheets

Related U.S. Application Data continuation of application No. PCT/CN2014/080682, filed on Jun. 25, 2014.

(56) References Cited

U.S. PATENT DOCUMENTS

| | | | |
|---|---|---|---|
| 5,649,053 | A | 7/1997 | Kim |
| 5,721,806 | A | 2/1998 | Lee |
| 6,148,283 | A | 11/2000 | Das |
| 2006/0277039 | A1 | 12/2006 | Vos et al. |
| 2008/0082321 | A1 | 4/2008 | Ide |
| 2009/0030678 | A1 | 1/2009 | Kovesi et al. |
| 2009/0157413 | A1 | 6/2009 | Oshikiri |
| 2010/0017199 | A1 | 1/2010 | Oshikiri et al. |
| 2010/0070269 | A1 | 3/2010 | Gao |
| 2011/0075855 | A1 | 3/2011 | Oh et al. |
| 2011/0125506 | A1 | 5/2011 | Wu et al. |
| 2011/0224994 | A1 | 9/2011 | Norvell et al. |
| 2011/0301961 | A1 | 12/2011 | Lee et al. |
| 2012/0185255 | A1 | 7/2012 | Virette et al. |
| 2012/0226505 | A1 | 9/2012 | Lin et al. |
| 2012/0290307 | A1 | 11/2012 | Kim et al. |
| 2013/0035943 | A1 | 2/2013 | Yamanashi et al. |
| 2013/0216053 | A1 | 8/2013 | Disch |
| 2013/0317811 | A1 | 11/2013 | Grancharov et al. |
| 2014/0156284 | A1 | 6/2014 | Porov et al. |

FOREIGN PATENT DOCUMENTS

| | | | |
|---|---|---|---|
| CN | 101377926 | A | 3/2009 |
| CN | 101494054 | A | 7/2009 |
| CN | 101523485 | A | 9/2009 |
| CN | 101853663 | A | 10/2010 |
| CN | 102110440 | A | 6/2011 |
| CN | 102576536 | A | 7/2012 |
| CN | 102859579 | A | 1/2013 |
| EP | 2398017 | A2 | 12/2011 |
| JP | H07183818 | A | 7/1995 |
| JP | H09261064 | A | 10/1997 |
| JP | 2005010337 | A | 1/2005 |
| JP | 2012518194 | A | 8/2012 |
| RU | 2420816 | C2 | 6/2011 |
| RU | 2464649 | C1 | 10/2012 |
| WO | 2010093224 | A2 | 8/2010 |

OTHER PUBLICATIONS

Painter et al., "A Review of Algorithms for Perceptual Coding of Digital Audio Signals," In Proceedings of 13th International Conference on Digital Signal Processing, IEEE, Jul. 1997, p. 179-208.

Office Action issued in Brazilian Application No. BR112015030852-0 dated Sep. 17, 2019, 7 pages.

Marina Bosi, et al. ISO/IEC MPEG-2 advanced audio coding. Journal of the Audio engineering society, 1997, vol. 45. No. 10, pp. 789-814.

Text of ISO/IEC13818-7:2004 (MPEG-2 AAC 3rd edition). ISO/IEC JTC1/SC29/WG11 N6428. Mar. 2004, 198 pages.

International Search Report and Written Opinion issued in International Application No. PCT/CN2014/080682 dated Oct. 14, 2014, 18 pages.

Japanese Office Action issued in Japanese Application No. 2016-522220 dated May 9, 2017, 4 pages.

Korean Office Action issued in Korean Application No. 10-2015-7034359 dated Oct. 26, 2016, 12 pages.

Russian Office Action issued in Russian Application No. 2015156053/08(086456) dated May 5, 2017, 9 pages.

Russian Search Report issued in Russian Application No. 2015156053/08(086456) dated May 2, 2017, 4 pages.

Singapore Search Report issued in Singapore Application No. 11201509391R dated Jan. 26, 2016, 3 pages.

Singapore Written Opinion issued in Singapore Application No. 11201509391R dated Jan. 26, 2018, 5 pages.

Chinese Office Action issued in Chinese Application No. 2013102710157 dated Mar. 3, 2017, 3 pages.

Chinese Search Report issued in Chinese Application No. 2013102710157 dated Feb. 23, 2017, 2 pages.

Office Action issued in Chinese Application No. 201711387694.9 dated Apr. 22, 2020, 16 pages (with English translation).

DYNAMIC BIT ALLOCATION METHODS AND DEVICES FOR AUDIO SIGNAL

CROSS-REFERENCE TO RELATED APPLICATION

This application is a continuation of U.S. patent application Ser. No. 14/984,703, filed on Dec. 30, 2015, which is a continuation of International Application No. PCT/CN2014/080682, filed on Jun. 25, 2014. The International Application claims priority to Chinese Patent Application No. 201310271015.7, filed on Jul. 1, 2013. All of which are hereby incorporated by reference in their entireties.

TECHNICAL FIELD

The present disclosure relates to the field of signal processing, and in particular, to signal encoding and decoding methods and devices.

BACKGROUND

There is an increased importance is attached to quality of a speech signal or an audio signal in communication transmission. As a consequence of this importance, higher requirements are imposed on signal encoding and decoding.

In existing medium and low rate signal encoding and decoding algorithms, because a quantity of bits available for allocation is insufficient, when the quantity of bits available for allocation is allocated in an entire frequency band many holes occur in a frequency spectrum. It is also possible that vectors still need to be indicated by one bit each, which causes a waste of bits when there is no information to convey. Moreover, due to some limitations of these algorithms, some bits may be left after encoding, which causes a waste of bits.

Systems and methods to improve signal encoding and decoding are needed.

SUMMARY

Embodiments of the present disclosure provide signal encoding and decoding methods and devices, which can improve auditory quality of a signal.

In one embodiment, a signal encoding method is disclosed that comprises determining, according to a quantity of available bits and a first saturation threshold i, a quantity k of subbands to be encoded, wherein i is a positive number, and k is a positive integer, selecting, according to quantized envelopes of all subbands, k subbands from all the subbands, or selecting k subbands from all the subbands according to a psychoacoustic model, and performing a first-time encoding operation on spectral coefficients of the k subbands.

In another embodiment, a signal decoding device is disclosed that includes a first determining unit, configured to determine, according to a quantity of available bits and a first saturation threshold i, a quantity k of subbands to be decoded, wherein i is a positive number, and k is a positive integer, a selecting unit, configured to: according to the quantity k of subbands that is determined by the first determining unit, select, according to decoded envelopes of all subbands, k subbands from all the subbands, or select k subbands from all the subbands according to a psychoacoustic model, and a decoding unit, configured to perform a first-time decoding operation, to obtain quantized spectral coefficients of the k subbands selected by the selecting unit.

In yet another embodiment, a signal encoding device is disclosed that includes a determining unit, configured to determine, according to a quantity of available bits and a first saturation threshold i, a quantity k of subbands to be encoded, wherein i is a positive number and k is a positive integer, a selecting unit, configured to select, according to the quantity k of subbands that is determined by the determining unit, k subbands from all the subbands, or select k subbands from all the subbands according to a psychoacoustic model, and an encoding unit, configured to perform a first-time encoding operation on spectral coefficients of the k subbands selected by the selecting unit.

BRIEF DESCRIPTION OF DRAWINGS

To describe the technical solutions in the embodiments of the present disclosure more clearly, the following briefly introduces the accompanying drawings required for describing the embodiments of the present disclosure. Apparently, the accompanying drawings in the following description show merely some embodiments of the present disclosure, and a person of ordinary skill in the art may still derive other drawings from these accompanying drawings without creative efforts.

DESCRIPTION OF EMBODIMENTS

The following clearly describes the technical solutions in the embodiments of the present disclosure with reference to the accompanying drawings in the embodiments of the present disclosure. Apparently, the described embodiments are some but not all of the embodiments of the present disclosure. All other embodiments obtained by a person of ordinary skill in the art based on the embodiments of the present disclosure without creative efforts shall fall within the protection scope of the present disclosure.

Encoding technologies and decoding technologies are widely applied in various electronic devices, for example, a mobile phone, a wireless apparatus, a personal data assistant (PDA), a handheld or portable computer, a global positioning system (GPS) receiver/navigator, a camera, an audio/video player, a video camera, a video recorder, and a monitoring device. Generally, this type of electronic device includes an audio encoder or an audio decoder, where the audio encoder or decoder may be directly implemented by a digital circuit or a chip, for example, a digital signal processor (DSP) chip, or be implemented by software code driving a processor to execute a process in the software code.

Figure 1:
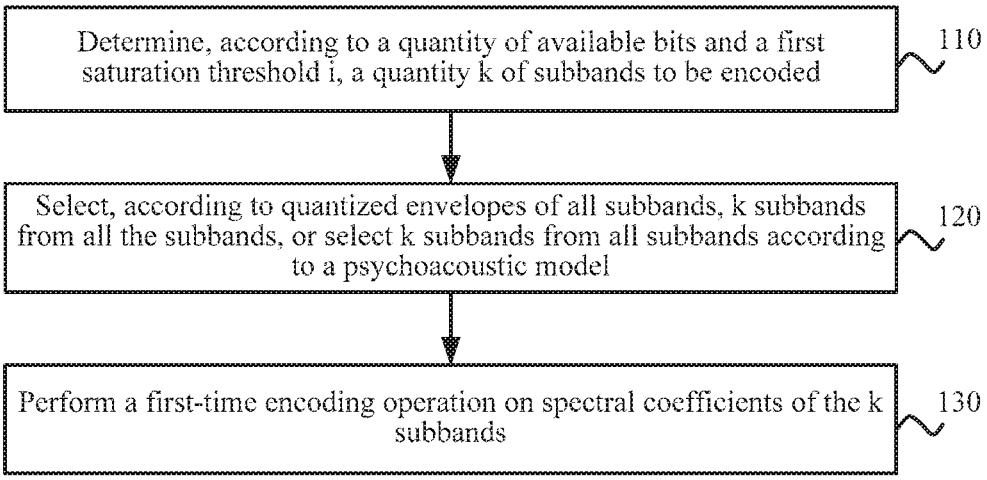
FIG. 1 is a schematic flowchart of a signal encoding method according to an embodiment of the present disclosure.

FIG. 1 is a schematic flowchart of a signal encoding method according to an embodiment of the present disclosure. The method illustrated by the flowchart of FIG. 1 is performed by an encoding end, for example, a speech encoder or an audio encoder. A signal in this embodiment of the present disclosure may refer to a speech signal or an audio signal.

In an encoding process, the encoding end may first transform a time domain signal into a frequency domain signal. For example, time-frequency transformation may be performed by using an algorithm such as a fast Fourier transform (FFT) algorithm or a modified discrete cosine transform (MDCT) algorithm. Subsequently, the encoding end may normalize a spectral coefficient of the frequency domain signal by using a global gain, and strip a normalized spectral coefficient to obtain subbands.

In block 110 of FIG. 1 describes determines, according to a quantity of available bits and a first saturation threshold i, a quantity k of subbands to be encoded, where i is a positive number, and k is a positive integer. The quantity of available bits may refer to a total quantity of bits that can be used for encoding. The first saturation threshold i may be predetermined. For example, the first saturation threshold i may be determined based on the following principle: When an average quantity of bits allocated for each spectral coefficient in a subband is greater than or equal to the first saturation threshold i, it may be considered that bits allocated to the subband reach saturation. The average quantity of bits allocated to each spectral coefficient may be a ratio of a quantity of bits allocated to the subband to a quantity of spectral coefficients of the subband. That bits allocated to the subband reach saturation may mean that even if more bits are allocated to the subband, performance of the subband is not obviously improved. The first saturation threshold i may be a positive number. Generally, $i \geq 1.5$.

Moreover, a threshold of the quantity of available bits may also be determined by using the first saturation threshold i and the quantity of spectral coefficients, and the quantity k of subbands to be encoded is further determined. For example, it is preset that i=2, a total quantity of subbands is 4, there are two subbands having 64 spectral coefficients, and there are two subbands having 72 spectral coefficients; in this case, a minimum quantity of spectral coefficients included in three subbands is: 64+64+72=200; therefore, a threshold of a quantity of available bits may be set to: 200×2=400; and when the quantity of available bits >400, k is 4; when the quantity of available bits ≤400, k is 3.

In block 120 of FIG. 1, the flowchart illustrates selecting, according to quantized envelopes of all subbands, k subbands from all the subbands, or select k subbands from all subbands according to a psychoacoustic model. In one embodiment of the present disclosure, the encoding end may select k subbands from all the subbands in descending order of quantized envelopes of all the subbands. Alternatively, the encoding end may determine importance of the subbands according to a psychoacoustic model, and may select k subbands in descending order of importance of the subbands.

In block 130 of FIG. 1, the flowchart illustrates performing a first-time encoding operation on spectral coefficients of the k subbands. The first-time encoding herein may refer to the first-time encoding operation performed by the encoding end on the spectral coefficients in the encoding process. In this embodiment of the present disclosure, the encoding operation may include operations such as normalization, quantization, and bitstream writing.

In one embodiment of the present disclosure, the encoding end first determines, according to a quantity of available bits and a first saturation threshold, a quantity k of subbands to be encoded. The encoding end then selects k subbands from all subbands for encoding, and the encoding end does not allocate bits to remaining subbands except the k subbands. Therefore, the remaining subbands are not encoded. In this way, the k subbands can be better encoded, and at a decoding end, spectrum holes of a signal obtained through decoding can be reduced, thereby improving quality of an output signal. Therefore, this embodiment of the present disclosure can improve auditory quality of a signal.

In this embodiment of the present disclosure, a quantity k of subbands to be encoded is determined according to a quantity of available bits and a first saturation threshold, and encoding is performed on k subbands that are selected from all subbands, instead of on an entire frequency band, which can reduce spectrum holes of a signal obtained through decoding, and therefore, can improve auditory quality of an output signal.

This embodiment of the present disclosure is applicable to various types of speech signals or audio signals, such as a transient signal, a fricative signal, or a long pitch signal.

Optionally, as an embodiment, if a signal is a transient signal, a fricative signal, or a long pitch signal, the encoding end may determine, according to the quantity of available bits and the first saturation threshold i, the quantity k of subbands to be encoded.

In one example, the encoding end may determine whether an input signal is a transient signal, a fricative signal, or a long pitch signal. It the input signal is a transient signal, a fricative signal, or a long pitch signal, the method of FIG. 1 may be performed. In this way, encoding quality of a transient signal, a fricative signal, or a long pitch signal can be improved.

Optionally, as another embodiment, in step 110, the encoding end may determine the quantity k of subbands according to equation (1):

$$k=\lfloor B/(i\times L)+0.5\rfloor \tag{1}$$

where B may indicate a quantity of available bits, and L may indicate a quantity of spectral coefficients in a subband.

Optionally, as an alternative embodiment, in step 130, the encoding end may normalize the spectral coefficients of the k subbands, to obtain normalized spectral coefficients of the k subbands, and quantize the normalized spectral coefficients of the k subbands, to obtain quantized spectral coefficients of the k subbands.

It is further understood that in block 130, the encoding operation may include a normalization operation and a quantization operation on the spectral coefficients. For example, the encoding end may normalize the spectral coefficients of the k subbands according to a process known to one skilled in the art. After normalizing the spectral coefficients of the k subbands, the encoding end may quantize the normalized spectral coefficients of the k subbands. For example, the encoding end may quantize the normalized spectral coefficients of the k subbands by using some lattice vector quantization (LVQ) algorithms, such as an algebraic vector quantization (AVQ) algorithm or a spherical vector quantization (SVQ) algorithm. These vector quantization algorithms have the following characteristic: After a quantity of bits to be allocated to each group of vectors to be quantized is determined, the quantity of bits allocated to each group of vectors is no longer adjusted according to a quantity of remaining bits, and a process of allocating bits to each group of vectors is relatively independent, where the quantity of bits to be allocated is determined only according to values of the group of vectors, and closed-loop bit allocation is not performed on all vectors.

Moreover, the encoding operation further includes a bitstream writing operation. For example, after normalizing and quantizing the spectral coefficients of the k subbands, the encoding end may write an index of the quantized spectral coefficients of the k subbands to a bitstream. The bitstream writing operation may be performed after the k subbands are quantized, or may be performed after a second-time encoding operation to be described below, which is not limited in this embodiment of the present disclosure.

Optionally, in another embodiment, after step 130, if a quantity of remaining bits in the quantity of available bits is greater than or equal to a first bit quantity threshold after the first-time encoding, the encoding end may determine, according to the quantity of remaining bits, a second saturation threshold j, and the quantized spectral coefficients of the k subbands, m vectors on which second-time encoding is to be performed, where j is a positive number, and m is a positive integer. Then the encoding end may perform a second-time encoding operation on spectral coefficients of the m vectors.

It is understood that in step 130, the encoding end performs the first-time encoding operation on the spectral coefficients of the k subbands, and after the first-time encoding operation, there may still be a quantity of remaining bits. The encoding end may compare the quantity of remaining bits with the first bit quantity threshold, and if the quantity of remaining bits is greater than or equal to the first bit quantity threshold, the encoding end may further perform a second-time encoding operation by using the quantity of remaining bits. The first bit quantity threshold and the second saturation threshold j may both be preset. The second saturation threshold j may be equal to or may not be equal to the first saturation threshold i, and the second saturation threshold j and the first saturation threshold i may both be determined based on a same principle, that is, the principle of determining the second saturation threshold j may be as follows: When an average quantity of bits allocated to each spectral coefficient in a vector is greater than or equal to the second saturation threshold j, it may be considered that bits allocated to the vector reach saturation. Generally, in most embodiments, $j \geq 1.5$.

In this embodiment, if the quantity of remaining bits after the first-time encoding operation is greater than or equal to the first bit quantity threshold, the m vectors on which second-time encoding is to be performed are determined according to the quantity of remaining bits, the second saturation threshold j, and the quantized spectral coefficients of the k subbands, and the second-time encoding operation is performed on the spectral coefficients of the m vectors; therefore, the quantity of remaining bits can be fully used, and encoding quality of a signal can be further improved.

Optionally, as another embodiment, the encoding end may determine, according to the quantity of remaining bits and the second saturation threshold j, a quantity m of vectors to be encoded. The encoding end may determine candidate spectral coefficients according to the quantized spectral coefficients of the k subbands; and select m vectors from vectors to which the candidate spectral coefficients belong, where the candidate spectral coefficients may include spectral coefficients that are obtained by subtracting the corresponding quantized spectral coefficients of the k subbands from the normalized spectral coefficients of the k subbands.

The normalized spectral coefficients of the k subbands are in a one-to-one correspondence with the quantized spectral coefficients of the k subbands, and therefore, when a subtraction operation is performed, the quantized spectral coefficients of the k subbands are subtracted from the normalized spectral coefficients of the k subbands in a one-to-one correspondence manner. For example, assuming that there are five normalized spectral coefficients in the k subbands, in step 130, the encoding end may normalize five spectral coefficients, to obtain five normalized spectral coefficients. Subsequently, the encoding end may quantize the five normalized spectral coefficients, to obtain five quantized spectral coefficients. The encoding end may subtract quantized spectral coefficients that respectively correspond to the five normalized spectral coefficients from the five normalized spectral coefficients. For example, the encoding end may subtract the first quantized spectral coefficient from the first normalized spectral coefficient to obtain a new spectral coefficient. In the same manner, the encoding end may obtain five new spectral coefficients. The five new spectral coefficients are candidate spectral coefficients.

Optionally, as another embodiment, the encoding end may determine the quantity m of vectors according to equation (2):

$$m=\lfloor C/(j\times M)+0.5\rfloor \tag{2}$$

where C may indicate a quantity of remaining bits, and M may indicate a quantity of spectral coefficients included in each vector.

Optionally, as another embodiment, the encoding end may sort the vectors to which the candidate spectral coefficients belong, to obtain sorted vectors. The encoding end may select the first m vectors from the sorted vectors, where the sorted vectors may be divided into a first group of vectors and a second group of vectors, the first group of vectors are arranged before the second group of vectors, the first group of vectors correspond to vectors whose values are all 0s in vectors to which the quantized spectral coefficients of the k subbands belong, and the second group of vectors correspond to vectors whose values are not all 0s in the vectors to which the quantized spectral coefficients of the k subbands belong.

It can be learned from the foregoing description that the candidate spectral coefficients are obtained by subtracting the quantized spectral coefficients of the k subbands from the normalized spectral coefficients of the k subbands. Therefore, the vectors to which the candidate spectral coefficients belong may also be construed as being obtained by subtracting, from vectors to which the normalized spectral coefficients belong, the vectors to which the quantized spectral coefficients belong. Vectors whose values are all 0s may exist in the vectors to which the quantized spectral coefficients of the k subbands belong, and the vectors whose values are all 0s may refer to vectors that include spectral coefficients that are all 0s. The encoding end may sort the vectors to which the candidate spectral coefficients belong, to obtain the sorted vectors. In the sorted vectors, vectors obtained by subtracting, from vectors whose values are all 0s in the vectors to which the normalized spectral coefficients of the k subbands belong, the vectors whose values are all 0s in the vectors to which the quantized spectral coefficients of the k subbands belong may be classified as the first group of vectors, and vectors obtained by subtracting the vectors whose values are not all 0s in the vectors to which the quantized spectral coefficients of the k subbands from vectors whose values are not all 0s in the vectors to which the normalized spectral coefficients of the k subbands belong may be classified as the second group of vectors.

The first group of vectors may be arranged before the second group of vectors; therefore, the encoding end may select the first m vectors starting from the first group of vectors. In one example, it is assumed that m is 5. If there are four vectors in the first group of vectors, the encoding end may select the four vectors from the first group of vectors, and then select one vector from the second group of vectors. If there are seven vectors in the first group of vectors, the encoding end may select the first five vectors from the first group of vectors. That is, when m vectors on which second-time encoding is to be performed are selected, a priority of the first group of vectors is higher than that of the second group of vectors.

Optionally, as another embodiment, in each group of vectors of the first group of vectors and the second group of vectors, vectors in different subbands may be arranged in ascending order of frequencies of the subbands in which the vectors are located, and vectors in a same subband may be arranged in an original order of the vectors.

An original order of vectors may refer to an original order of vectors in a subband to which the vectors belong. For example, it is assumed that there are five vectors in the first group of vectors, which are numbered as vector 0, vector 1, vector 2, vector 3, and vector 4. Vector 1 and vector 2 belong to subband 0, vector 0 and vector 3 belong to subband 1, and vector 4 belong to subband 2. In subband 0, an original order of vectors is as follows: Vector 1 is arranged before vector 2. In subband 1, an original order of vectors is as follows: Vector 0 is arranged before vector 3. In the three subbands, a frequency of subband 0 is the lowest, a frequency of subband 2 is the highest, and a frequency of subband 1 is between the frequency of subband 0 and the frequency of subband 2. Then, the five vectors in the first group of vectors may be sorted in the following manner: First, vectors belonging to different subbands are sorted in ascending order of frequencies of the subbands, that is, the vectors belonging to subband 0 are arranged at the top, the vectors belonging to subband 1 are arranged in the middle, and the vector belonging to subband 2 are arranged at the bottom. Then, vectors belonging to a same subband may be sorted in an original order of the vectors. In this way, the five vectors in the first group of vectors may be sorted in the following order: vector 1, vector 2, vector 0, vector 3, and vector 4. The vectors of the second group of vectors are sorted in a manner similar to the manner in which the vectors of the first group of vectors are sorted, and details are not described again.

Optionally, as another embodiment, in each group of vectors of the first group of vectors and the second group of vectors, vectors in different subbands are arranged in descending order of quantized envelopes of the subbands in which the vectors are located, and vectors in a same subband are arranged in an original order of the vectors.

In this embodiment, vectors in different subbands are sorted in an order of quantized envelopes of subbands. Vectors in a same subband are still sorted in an original order of the vectors. For example, it is assumed that there are five vectors in the first group of vectors, which are numbered as vector 0, vector 1, vector 2, vector 3, and vector 4. Vector 1 and vector 2 belong to subband 0, vector 0 and vector 3 belong to subband 1, and vector 4 belong to subband 2. In subband 0, an original order of vectors is as follows: Vector 1 is arranged before vector 2. In subband 1, an original order of vectors is as follows: Vector 0 is arranged before vector 3. In the three subbands, a quantized envelope of subband 2 is the smallest, a quantized envelope of subband 1 is the largest, and a quantized envelope of subband 0 is between the quantized envelope of subband 2 and the quantized envelope of subband 1. In this way, the five vectors in the first group of vectors may be sorted in the following order: vector 0, vector 3, vector 1, vector 2, and vector 4.

Optionally, as another embodiment, the encoding end may select, in descending order of quantized envelopes of subbands in which the vectors to which the candidate spectral coefficients belong are located, the m vectors from the vectors to which the candidate spectral coefficients belong.

In this embodiment, the encoding end may no longer group the vectors to which the candidate spectral coefficients belong, but may directly select the m vectors in descending order of the quantized envelopes of the subbands. For example, it is assumed that there are four vectors, which are numbered as: vector 0, vector 1, vector 2, and vector 3. The four vectors belong to four subbands, that is, subband 0, subband 1, subband 2, and subband 3. It is assumed that a descending order of quantized envelopes of the subbands is as follows: Subband 2>subband 1>subband 3>subband 0. If three vectors are to be selected for second-time encoding, vector 2, vector 1, and vector 3 are selected in descending order of the quantized envelopes of the subbands.

If multiple vectors belong to a same subband, selection may be performed in an original order of the multiple vectors in the subband, or for the multiple vectors in the subband, vectors whose values are all 0s may be selected first, and then vectors whose values are not all 0s are selected. For example, it is assumed that there are five vectors, which are numbered as: vector 0 to vector 4. Vector 0 belongs to subband 0, vector 1 to vector 3 belongs to subband 1, and vector 4 belongs to subband 2. It is assumed that a descending order of quantized envelopes of the subbands is as follows: Subband 2>subband 1>subband 0. If three vectors are to be selected for second-time encoding, in descending order of quantized envelopes of the subbands, vector 4 is selected first, and then the remaining two vectors need to be selected from vector 1 to vector 3 in subband 1. At this time, the remaining two vectors may be selected in an original order of vector 1 to vector 3 in subband 1, or vectors whose values are all 0s in vector 1 to vector 3 may be preferentially selected, and then vectors whose values are not all 0s are selected.

When performing second-time encoding on the spectral coefficients of the m vectors, the encoding end may first normalize the spectral coefficients of the m vectors, and then quantize normalized spectral coefficients of the m vectors. For example, the encoding end may quantize the normalized spectral coefficients of the m vectors by using a vector quantization algorithm, such as an AVQ algorithm or an SVQ algorithm, that is used when first-time encoding is performed. After quantized spectral coefficients of the m vectors are obtained, the encoding end may perform a bitstream writing operation on the quantized spectral coefficients of the m vectors.

The encoding end may normalize the spectral coefficients of the m vectors by using different global gains.

Optionally, as another embodiment, the encoding end may determine global gains of the spectral coefficients of the m vectors; normalize the spectral coefficients of the m vectors by using the global gains of the spectral coefficients of the m vectors; and then may quantize normalized spectral coefficients of the m vectors.

Optionally, as another embodiment, the encoding end may determine global gains of spectral coefficients of the first group of vectors and global gains of spectral coefficients of the second group of vectors. The encoding end may normalize spectral coefficients of vectors that belong to the first group of vectors and are in the m vectors by using the global gains of the spectral coefficients of the first group of vectors, and normalize spectral coefficients of vectors that belong to the second group of vectors and are in the m vectors by using the global gains of the spectral coefficients of the second group of vectors. Then the encoding end may quantize normalized spectral coefficients of the m vectors.

For example, the encoding end may also normalize, by using respective global gains of the two groups of vectors, vectors selected from the two groups of vectors.

Figure 2:
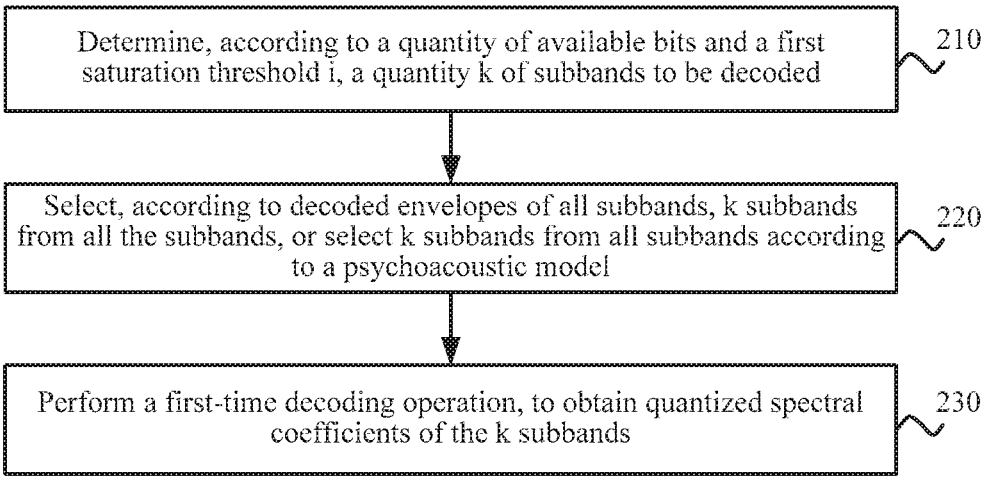
FIG. 2 is a schematic flowchart of a signal decoding method according to another embodiment of the present disclosure.

The process of encoding a signal by the encoding end is described above, and decoding is an inverse process of encoding. FIG. 2 is a schematic flowchart of a signal decoding method according to another embodiment of the present disclosure. The method of FIG. 2 is performed by a decoding end, for example, a speech decoder or an audio decoder.

In a decoding process, the decoding end may decode a bitstream received from an encoding end. For example, the decoding end may perform core layer decoding to obtain low frequency band information, and decode envelopes and global gains of subbands of a high frequency band. Subsequently, the decoding end may perform a decoding operation and a restoring operation on spectral coefficients of the high frequency band by using the foregoing information obtained through decoding.

In block 210 of FIG. 2, the method depicts determining, according to a quantity of available bits and a first saturation threshold i, a quantity k of subbands to be decoded, where i is a positive number, and k is a positive integer.

It is understood that block 210 may be similar to step 110 of FIG. 1, and is not described herein again. The first saturation threshold i may be predetermined; therefore, the encoding end and the decoding end may use a same first saturation threshold i.

In block 220 of FIG. 2, the method depicts selecting, according to decoded envelopes of all subbands, k subbands from all the subbands, or select k subbands from all subbands according to a psychoacoustic model. For example, the decoding end may select k subbands from all the subbands in descending order of the decoded envelopes of all the subbands. Alternatively, the decoding end may determine importance of the subbands according to a psychoacoustic model, and may select k subbands in descending order of importance of the subbands.

In block 230 the method depicts performing a first-time decoding operation, to obtain quantized spectral coefficients of the k subbands. Similar to a case of the encoding end, the first-time decoding operation may refer to the first-time decoding operation performed by the decoding end on spectral coefficients in the decoding process. The first-time decoding operation may include an operation such as de-quantization. For a specific process of the decoding operation, refer to the prior art. For example, the decoding end may perform the first-time decoding operation on the received bitstream. For example, the decoding end may perform a first-time de-quantization operation based on the received bitstream and by using a vector quantization algorithm, such as an AVQ algorithm or an SVQ algorithm that is used when the encoding end quantizes normalized spectral coefficients of k subbands, to obtain the quantized spectral coefficients of the k subbands.

When encoding spectral coefficients, the encoding end first determines, according to the quantity of available bits and the first saturation threshold, a quantity k of subbands to be encoded, and then selects k subbands from all subbands. Because the decoding process is an inverse process of the encoding process, when decoding spectral coefficients, the decoding end may first determine, according to the quantity of available bits and the first saturation threshold, the quantity k of subbands to be decoded, and then select the k subbands from all the subbands for decoding, which, therefore, can improve quality of a signal obtained through decoding, and can further improve auditory quality of an output signal.

In this embodiment of the present disclosure, a quantity k of subbands to be decoded is determined according to a quantity of available bits and a first saturation threshold, and decoding is performed on k subbands that are selected from all subbands, which can reduce spectrum holes of a signal obtained through decoding, and therefore, can improve auditory quality of an output signal.

This embodiment of the present disclosure is applicable to various types of speech signals or audio signals, such as a transient signal, a fricative signal, or a long pitch signal.

Optionally, as an embodiment, if a signal is a transient signal, a fricative signal, or a long pitch signal, the decoding end may determine, according to the quantity of available bits and the first saturation threshold i, the quantity k of subbands to be decoded.

Specifically, the decoding end may determine, according to a type of a decoded signal or a signal type extracted from the low frequency band information obtained through decoding, whether a signal to be decoded is a transient signal, a fricative signal, or a long pitch signal. It the signal to be decoded is a transient signal, a fricative signal, or a long pitch signal, the method of FIG. 2 may be performed. In this way, quality of a transient signal, a fricative signal, or a long pitch signal can be improved.

Optionally, as another embodiment, in block 210 of FIG. 2, the decoding end may also determine the quantity k of subbands according to equation (1).

Optionally, as another embodiment, after block 230 of FIG. 2, if a quantity of remaining bits in the quantity of available bits is greater than or equal to a first bit quantity threshold after the first-time decoding operation, the decoding end may determine, according to the quantity of remaining bits and a second saturation threshold j, a quantity m of vectors on which second-time decoding is to be performed, where j is a positive number, and m is a positive integer. Then, the decoding end may perform a second-time decoding operation, to obtain normalized spectral coefficients of the m vectors.

The encoding end may have performed a second-time encoding operation after a first-time encoding operation; therefore, the decoding end may determine, in a same determining manner, whether a second-time decoding operation needs to be performed. The second saturation threshold j may also be predetermined; therefore, the decoding end and the encoding end may use a same second saturation threshold j. For the principle of determining the second saturation threshold j, refer to the description in the embodiment of FIG. 1, and details are not described herein again.

The second-time decoding operation may include an operation such as de-quantization. For example, the decoding end may perform, based on the received bitstream, a second-time de-quantization operation by using the vector quantization algorithm, such as the AVQ algorithm or the SVQ algorithm, that is used when the first-time decoding operation is performed, to obtain the normalized spectral coefficients of the m vectors.

Optionally, as another embodiment, the decoding end may also determine the quantity m of vectors according to equation (2).

Optionally, as another embodiment, the decoding end may determine a correspondence between the normalized spectral coefficients of the m vectors and the quantized spectral coefficients of the k subbands.

Optionally, as another embodiment, the decoding end may determine a correspondence between the m vectors and a first type of vectors in vectors to which the quantized spectral coefficients of the k subbands belong, where the m vectors are in a one-to-one correspondence with the first type of vectors.

It can be learned from the process of the embodiment of FIG. 1 that, the encoding end selects the m vectors from the vectors to which the candidate spectral coefficients belong for second-time encoding, and the candidate spectral coefficients are obtained by subtracting the quantized spectral coefficients of the k subbands from the normalized spectral coefficients of the k subbands; therefore, after obtaining the normalized spectral coefficients of the m vectors through the second-time decoding, the decoding end needs to determine which vectors in the vectors to which the candidate spectral coefficients belong are specifically the m vectors, that is, determine the one-to-one correspondence between the m vectors and the first type of vectors in the vectors to which the quantized spectral coefficients of the k subbands belong.

Specifically, the decoding end may determine, base on different manners, the correspondence between the m vectors and the first type of vectors in the vectors to which the quantized spectral coefficients of the k subbands belong. It should be understood that the manner used by the decoding end should be the same as the manner in which the encoding end selects the m vectors for the second-time encoding.

Optionally, as another embodiment, the decoding end may sort the vectors to which the quantized spectral coefficients of the k subbands belong, to obtain sorted vectors; and then the decoding end may select the first m vectors from the sorted vectors as the first type of vectors, and establish a correspondence between the first type of vectors and the m vectors, where the sorted vectors are divided into a first group of vectors and a second group of vectors, the first group of vectors are arranged before the second group of vectors, the first group of vectors include vectors whose values are all 0s in vectors to which a first group of decoded spectral coefficients belong, and the second group of vectors include vectors whose values are not all 0s in the vectors to which the first group of decoded spectral coefficients belong.

Specifically, the decoding end may sort the vectors to which the quantized spectral coefficients of the k subbands belong, to obtain the sorted vectors. The sorted vectors may be considered as including the two groups of vectors. The first group of vectors are arranged before the second group of vectors, the first group of vectors are vectors whose values are all 0s, and the second group of vectors are vectors whose values are not all 0s. Subsequently, the decoding end may select the first m vectors from the sorted vectors as the first type of vectors. It can be seen that when the first type of vectors are selected, a priority of the first group of vectors is higher than that of the second group of vectors.

Vectors in each group of vectors may also be sorted in different manners.

Optionally, as another embodiment, in each group of vectors of the first group of vectors and the second group of vectors, vectors in different subbands are arranged in ascending order of frequencies of the subbands in which the vectors are located, and vectors in a same subband are arranged in an original order of the vectors.

Optionally, as another embodiment, in each group of vectors of the first group of vectors and the second group of vectors, vectors in different subbands are arranged in descending order of quantized envelopes of the subbands in which the vectors are located, and vectors in a same subband are arranged in an original order of the vectors.

Optionally, as another embodiment, the decoding end may select, in descending order of quantized envelopes of subbands in which the vectors to which the quantized spectral coefficients of the k subbands belong are located, m vectors from the vectors to which the quantized spectral coefficients of the k subbands belong as the first type of vectors. The decoding end may establish a correspondence between the first type of vectors and the m vectors.

Optionally, as another embodiment, the decoding end may decode global gains of the m vectors; and correct the normalized spectral coefficients of the m vectors by using the global gains of the m vectors, to obtain spectral coefficients of the m vectors.

The decoding end may correct a second group of decoded spectral coefficients, and herein, the decoding end may correct the normalized spectral coefficients of the m vectors by using the global gains of the m vectors obtained through decoding.

Optionally, as another embodiment, the decoding end may decode a first global gain and a second global gain; and correct, by using the first global gain, spectral coefficients that correspond to the first group of vectors and are in the normalized spectral coefficients of the m vectors, and correct, by using the second global gain, spectral coefficients that correspond to the second group of vectors and are in the normalized spectral coefficients of the m vectors, to obtain spectral coefficients of the m vectors.

It can be learned from the process of the embodiment of FIG. 1 that, the encoding end may normalize the spectral coefficients of the m vectors by using the two global gains. Therefore, correspondingly, the decoding end may correct the normalized spectral coefficients of the m vectors by using the two global gains.

Optionally, as another embodiment, the decoding end may add together the quantized spectral coefficients of the k subbands and the spectral coefficients of the m vectors, to obtain normalized spectral coefficients of the k subbands. The decoding end may perform noise filling on a spectral coefficient whose value is 0 in the normalized spectral coefficients of the k subbands, and restore a spectral coefficient of another subband in all the subbands except the k subbands, to obtain spectral coefficients of a first frequency band, where the first frequency band includes all the subbands. The decoding end may correct the spectral coefficients of the first frequency band by using the envelopes of all the subbands, to obtain normalized spectral coefficients of the first frequency band; and correct the normalized spectral coefficients of the first frequency band by using a global gain of the first frequency band, to obtain a final frequency domain signal of the first frequency band.

After two times of decoding, spectral coefficients obtained through the two times of decoding belong to k subbands to which bits are allocated; therefore, the decoding end adds together the spectral coefficients that are obtained through the two times of decoding, to obtain normalized spectral coefficients of the k subbands. Specifically, the quantized spectral coefficients of the k subbands are essentially spectral coefficients on which first-time normalization processing is performed by the encoding end. The normalized spectral coefficients of the m vectors are essentially spectral coefficients on which second-time normalization processing is performed by the encoding end; therefore, the decoding end needs to correct the normalized spectral coefficients of the m vectors, to obtain the spectral coefficients of the m vectors. Subsequently, the quantized spectral coefficients of the k subbands and the spectral coefficients of the m vectors may be added together, to obtain the normalized spectral coefficients of the k subbands. For spectral coefficients whose values are 0s in the normalized spectral coefficients of the k subbands, the decoding end may generally fill some noise, so that a reconstructed audio signal sounds more natural. In addition, the decoding end further needs to restore a spectral coefficient of another subband in all the subbands except the k subbands; because the first frequency band includes all the foregoing subbands, the spectral coefficients of the first frequency band are obtained. Herein, the first frequency band may refer to a full frequency band, or may be some frequency bands in the full frequency band. That is, this embodiment of the present disclosure may be applied to processing of the full frequency band, or may be applied to processing of some frequency bands in the full frequency band.

Optionally, as another embodiment, the decoding end may add together the spectral coefficients of the m vectors and the quantized spectral coefficients of the k subbands according to a correspondence between the normalized spectral coefficients of the m vectors and the quantized spectral coefficients of the k subbands.

Specifically, the decoding end may determine, according to the correspondence, which vectors in the vectors to which the candidate spectral coefficients belong are the m vectors, and the vectors to which the candidate spectral coefficients belong are obtained by subtracting, from the vectors to which the normalized spectral coefficients of the k subbands belong, the vectors to which the quantized spectral coefficients of the k subbands belong; therefore, to obtain the normalized spectral coefficients of the k subbands, the decoding end may add, according to the correspondence, the spectral coefficients of the m vectors to the quantized spectral coefficients of the k subbands that correspond to the spectral coefficients of the m vectors.

To perform noise filling on a spectral coefficient whose value is 0 in the normalized spectral coefficients of the k subbands, optionally, as another embodiment, the decoding end may determine a weighted value according to core layer decoding information, and then weight spectral coefficients that are adjacent to the spectral coefficient whose value is 0 in the normalized spectral coefficients of k subbands and random noise by using the weighted value.

Specifically, for the spectral coefficient whose value is 0, the decoding end may weight the spectral coefficients that are adjacent to the spectral coefficient whose value is 0 and the random noise.

Optionally, as another embodiment, the decoding end may acquire signal classification information from the core layer decoding information; and if the signal classification information indicates that a signal is a fricative signal, the decoding end may acquire a predetermined weighted value; or if the signal classification information indicates that a signal is another signal except a fricative signal, the decoding end may acquire a pitch period from the core layer decoding information, and determine the weighted value according to the pitch period.

When the noise filling is performed in a weighting manner, the decoding end may use different weighted values for different signal types. For example, if the signal is a fricative signal, the weighted value may be preset. For another signal except the fricative signal, the decoding end may determine the weighted value according to the pitch period. Generally, a longer pitch period indicates a smaller weighted value.

Optionally, as another embodiment, the decoding end may select, from all the subbands, n subbands that are adjacent to the another subband, and restore the spectral coefficient of the another subband according to spectral coefficients of the n subbands, where n is a positive integer; or the decoding end may select p subbands from the k subbands, and restore the spectral coefficient of the another subband according to spectral coefficients of the p subbands, where a quantity of bits allocated to each subband in the p subbands is greater than or equal to a second bit quantity threshold, where p is a positive integer.

Specifically, the decoding end may restore the spectral coefficient of the another subband by using the spectral coefficients of the subbands that are adjacent to the another subband except the k subbands. Alternatively, the decoding end may restore the spectral coefficient of the another subband by using a spectral coefficient of a subband to which a relatively large quantity of bits are allocated. For example, that a relatively large quantity of bits are allocated may refer to that a quantity of bits is greater than or equal to a preset second bit quantity threshold.

After obtaining the final frequency domain signal, the decoding end may perform frequency-time transformation on the final frequency domain signal, to obtain a final time domain signal.

This embodiment of the present disclosure is described below with reference to specific examples. It should be understood that these examples are only provided to help a person skilled in the art better understand this embodiment of the present disclosure, but not intended to limit the scope of this embodiment of the present disclosure.

Figure 3:
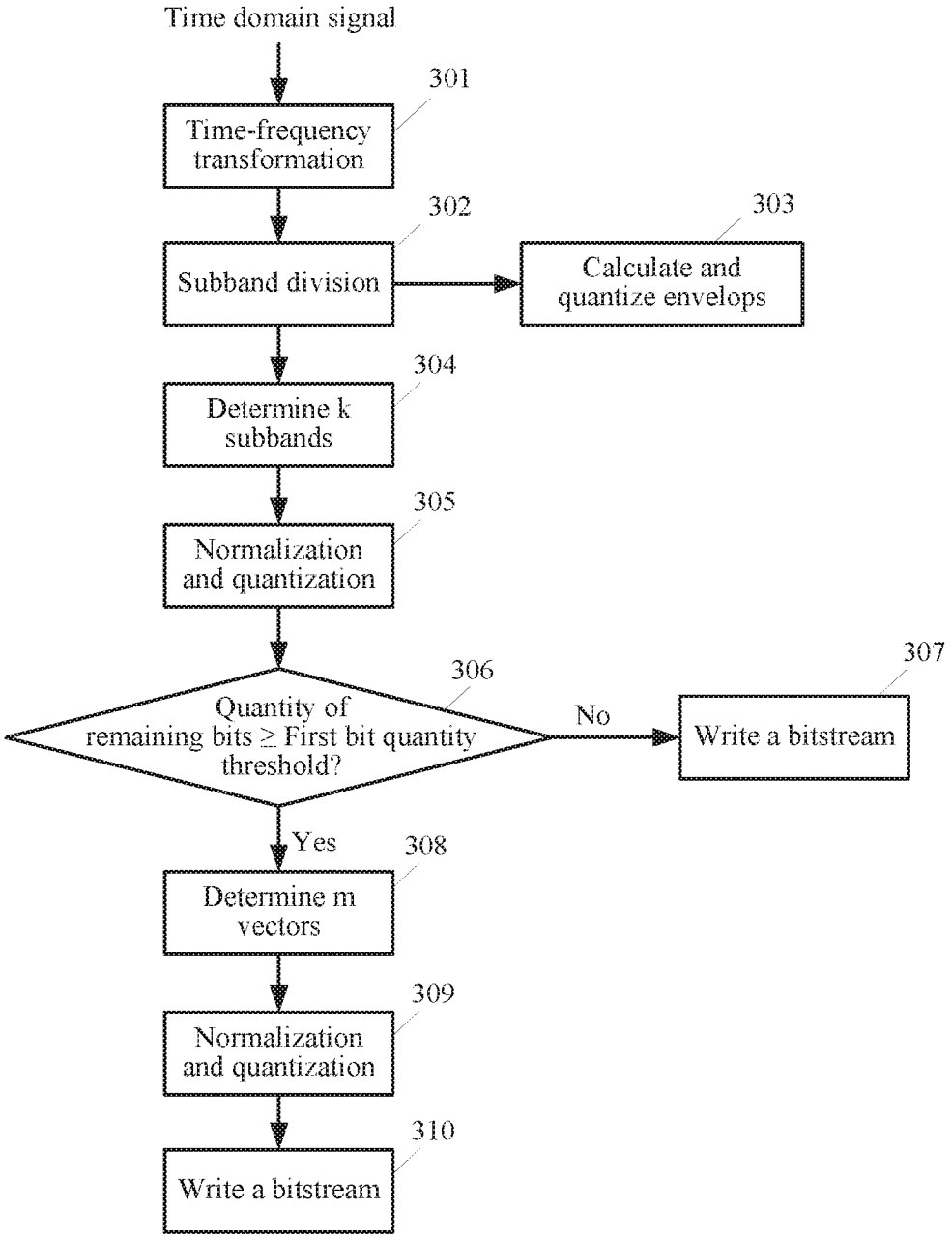
FIG. 3 is a schematic flowchart of a process of a signal encoding method according to an embodiment of the present disclosure.

FIG. 3 is a schematic flowchart of a process of a signal encoding method according to an embodiment of the present disclosure. A time domain signal is provided to the time-frequence transformation block 301. In block 301, an encoding end performs time-frequency transformation on a time domain signal. In block 302, The encoding end performs subband division for a spectral coefficient of a frequency domain signal.

Specifically, the encoding end may calculate a global gain, normalize original spectral coefficients by using the global gain, and then strip normalized spectral coefficients, to obtain all subbands.

In block 303, the encoding end calculates envelopes of all the subbands, and quantizes the envelopes of all the subbands, to obtain quantized envelopes of all the subbands.

In block 304, the encoding end determines k subbands to be encoded.

Specifically, the encoding end may determine the k subbands by using the process in the embodiment of FIG. 1, which is not described herein again.

In block 305, the encoding end normalizes and quantizes spectral coefficients of the k subbands.

Specifically, the encoding end may normalize the spectral coefficients of the k subbands, to obtain normalized spectral coefficients of the k subbands. Subsequently, the encoding end may quantize the normalized spectral coefficients of the k subbands. For example, the encoding end quantizes the normalized spectral coefficients of the k subbands by using a lattice vector quantization algorithm, to obtain quantized spectral coefficients of the k subbands.

In block 306, the encoding end determines, after first-time encoding, whether a quantity of remaining bits in a quantity of available bits is greater than or equal to a first bit quantity threshold. If the quantity of remaining bits is less than the first bit quantity threshold, the method proceeds to block 307. If the quantity of remaining bits is greater than or equal to the first bit quantity threshold, the method proceeds to block 308.

In block 307, the encoding end writes a bitstream. Specifically, if the quantity of remaining bits is less than the first bit quantity threshold, the quantity of remaining bits cannot be used for second-time encoding, and the encoding end may write, to the bitstream, an index of a result of the first-time encoding, an index of a quantized global gain, an index of quantized envelopes of all the subbands, and the like. For a specific process, refer to the prior art, and details are not described herein again.

In block 308, if the quantity of remaining bits is greater than or equal to the first bit quantity threshold, the encoding end determines m vectors on which second-time encoding is to be performed. Specifically, the encoding end may determine candidate spectral coefficients according to the quantized spectral coefficients of the k subbands, and select m vectors from vectors to which the candidate spectral coefficients belong.

The foregoing candidate spectral coefficients may include spectral coefficients obtained by subtracting corresponding quantized spectral coefficients of the k subbands from normalized spectral coefficients of the k subbands.

As an example, the encoding end may select the first m vectors from vectors to which the candidate spectral coefficients belong, where the vectors to which the candidate spectral coefficients belong may be divided into a first group of vectors and a second group of vectors, the first group of vectors are arranged before the second group of vectors, the first group of vectors correspond to vectors whose values are all 0s in vectors to which the quantized spectral coefficients of the k subbands belong, and the second group of vectors correspond to vectors whose values are not all 0s in the vectors to which the quantized spectral coefficients of the k subbands belong.

Figure 4:
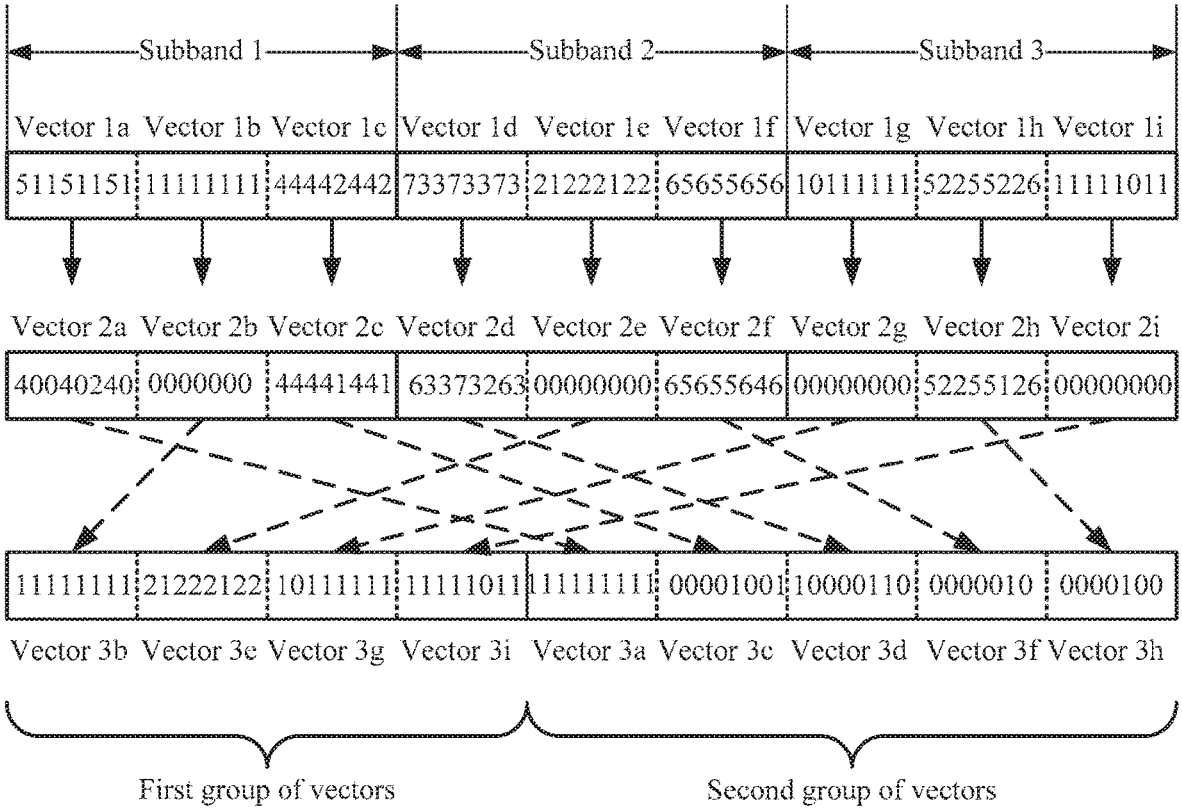
FIG. 4 is a schematic diagram of a process of determining a vector on which second-time encoding is to be performed according to an embodiment of the present disclosure.

Description is provided below with reference to a specific example. FIG. 4 is a schematic diagram of a process of determining a vector on which second-time encoding is to be performed according to an embodiment of the present disclosure.

In FIG. 4, it is assumed that when first-time encoding is performed, the encoding end determines three subbands, which are numbered as subband 1 to subband 3. Subband 1 to subband 3 are arranged in ascending order of frequencies. There are three vectors in each subband, which may be numbered as vector 1*a* to vector 1*i*. There are eight normalized spectral coefficients in each vector, and specific values of these spectral coefficients may be shown in FIG. 4. For example, normalized spectral coefficients included in vector 1*a* in subband 1 are 51151151.

Normalized spectral coefficients of the three subbands are quantized, to obtain quantized spectral coefficients, and specific values of the quantized spectral coefficients are shown in FIG. 4. Some spectral coefficients are quantized to 0, and some spectral coefficients are quantized to values that are not 0. These quantized spectral coefficients also belong to nine vectors, which may be numbered as vector 2*a* to vector 2*i*. For example, eight normalized spectral coefficients included in vector 1*a* in subband 1 are quantized, to obtain eight quantized spectral coefficients being 40040240, which belong to vector 2*a*. Eight normalized spectral coefficients included in vector 1*b* in subband 1 are quantized, to obtain eight quantized spectral coefficients being 00000000, which belong to vector 2*b*.

Corresponding quantized spectral coefficients are subtracted from normalized spectral coefficients, to obtain candidate spectral coefficients. For example, for vector 1*a* in subband 1, the corresponding eight quantized spectral coefficients being 40040240 are subtracted from the eight normalized spectral coefficients 51151151, to obtain new spectral coefficients 11111111. For vector 1*b* in subband 1, the eight quantized spectral coefficients 00000000 are subtracted from eight normalized spectral coefficients 11111111, to obtain new spectral coefficients 11111111; and other spectral coefficients can also be obtained in the same manner. All the obtained new spectral coefficients are the candidate spectral coefficients, as shown in FIG. 4.

It can be seen from the foregoing description that the vectors to which the candidate spectral coefficients belong may also be construed as being obtained by subtracting, from the vectors to which the normalized spectral coefficients belong, the vectors to which the quantized spectral coefficients belong. Therefore, correspondingly, these candidate spectral coefficients also belong to nine vectors, which, to correspond to the foregoing normalized vectors and quantized vectors, may be numbered as vector 3*a* to vector 3*i*, as shown in FIG. 4. For example, quantized vector 2*a* is subtracted from vector 1*a* to obtain vector 3*a*, and quantized vector 2*b* is subtracted from vector 1*b* to obtain vector 3*b*.

The nine vectors may include two groups of vectors. There are four vectors, that is, vector 3*b*, vector 3*e*, vector 3*g*, and vector 3*i* in the first group of vectors. There are five vectors, that is, vector 3*a*, vector 3*c*, vector 3*d*, vector 3*f*, and vector 3*h* in the second group of vectors. The first group of vectors are obtained by subtracting vectors whose values are all 0s in vector 2*a* to 2*i*. For example, vector 3*b* is obtained by subtracting vector 2*b* whose values are all 0s from vector 1*b*; vector 3*e* is obtained by subtracting vector 2*e* whose values are all 0s from vector 1*e*; and other vectors can also be obtained in the same manner. The second group of vectors are obtained by subtracting vectors whose values are not all 0s in vector 2*a* to 2*i*. For example, vector 3*a* is obtained by subtracting vector 1*b* whose values are not all 0s from vector 1*a*; vector 3*c* is obtained by subtracting vector 2*c* whose values are not all 0s from vector 1*c*; other vectors can also be obtained in the same manner.

As shown in FIG. 4, each group of vectors may be arranged in ascending order of frequencies of subbands, and vectors in a same subband may be arranged in an original order of the vectors. For example, in the first group of vectors, vector 3*b* belongs to subband 1, vector 3*e* belongs to subband 2, and vector 3*g* and vector 3*i* belong to subband 3. In the second group of vectors, vector 3*a* and vector 3*c* belong to subband 1, vector 3*d* and vector 3*f* belong to subband 2, and vector 3*h* belongs to subband 3.

The encoding end may select, from the group of vectors that include the first group of vectors and the second group of vectors, the first m vectors as vectors for second-time encoding. For example, the first three vectors, that is, vector 3*b*, vector 3*e*, and vector 3*g*, may be selected for second-time encoding.

It should be understood that specific values in FIG. 4 are only provided to help a person skilled in the art better understand this embodiment of the present disclosure, but not intended to limit the scope of this embodiment of the present disclosure.

Moreover, in addition to the manners in which vectors in each group of vectors are sorted shown in FIG. 4, in each group of vectors, vectors in different subbands may also be arranged in descending order of quantized envelopes of subbands in which the vectors are located, and vectors in a same subband may be arranged in an original order of the vectors.

Returning to block 309 of FIG. 3, the encoding end normalizes and quantizes spectral coefficients of the m vectors. For specific processes of normalizing and quantizing the spectral coefficients of the m vectors, refer to content described in the embodiment of FIG. 1, and details are not described herein again.

Finally, in block 310 of FIG. 3, The encoding end writes a bitstream. Specifically, the encoding end may write, to the bitstream, an index of spectral coefficients obtained through first-time encoding, an index of spectral coefficients obtained through second-time encoding, an index of a quantized global gain, an index of quantized envelopes of all the subbands, and the like. For a specific process, refer to the prior art, and details are not described herein again.

In this embodiment of the present disclosure, a quantity k of subbands to be encoded is determined according to a quantity of available bits and a first saturation threshold, and encoding is performed on k subbands that are selected from all subbands, instead of on an entire frequency band, which can reduce spectrum holes of a signal obtained through decoding, and therefore, can improve auditory quality of an output signal.

A specific decoding process is an inverse process of the encoding process shown in FIG. 3. How to determine a one-to-one correspondence between the m vectors and a first type of vectors in the vectors to which the quantized spectral coefficients of the k subbands belong is highlighted below with reference to the examples in FIG. 4. For other processes, refer to the process of the embodiment of FIG. 2, and details are not described again.

For example, the decoding end may obtain spectral coefficients of vector 2*a* to vector 2*i* through the first-time decoding. It is assumed that m is determined to be 5 according to a quantity of remaining bits and a second saturation threshold j. The decoding end may obtain, through second-time decoding, spectral coefficients of five vectors, that is, vector 3*b*, vector 3*e*, vector 3*g*, vector 3*i*, and vector 3*a*. The decoding end needs to respectively add together the spectral coefficients of the five vectors and spectral coefficients of vector 2*b*, vector 2*e*, vector 2*g*, vector 2*i*, and vector 2*a*. However, after obtaining, through decoding, vector 3*b*, vector 3*e*, vector 3*g*, vector 3*i*, and vector 3*a*, the decoding end does not know which five vectors in vector 2*a* to vector 2*i* correspond to the obtained five vectors. Therefore, the decoding end first needs to determine a one-to-one correspondence between the five vectors and vector 2*b*, vector 2*e*, vector 2*g*, vector 2*i*, and vector 2*a*, that is, vector 2*b*, vector 2*e*, vector 2*g*, vector 2*i*, and vector 2*a* are a first type of vectors in the vectors to which the quantized spectral coefficients of the k subbands belong, and then respectively adds together spectral coefficients of vector 3*b*, vector 3*e*, vector 3*g*, vector 3*i*, and vector 3*a* and spectral coefficients of vector 2*b*, vector 2*e*, vector 2*g*, vector 2*i*, and vector 2*a*. Specifically, the decoding end may perform the determining in the manner described in the embodiment of FIG. 2, which is not described herein again.

Figure 5:
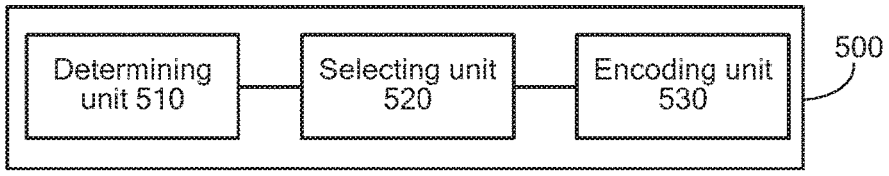
FIG. 5 is a schematic block diagram of a signal encoding device according to an embodiment of the present disclosure.

FIG. 5 is a schematic block diagram of a signal encoding device according to an embodiment of the present disclosure. For example, a device 500 of FIG. 5 may be a speech encoder or an audio encoder. The device 500 includes a determining unit 510, a selecting unit 520, and an encoding unit 530.

The determining unit 510 determines, according to a quantity of available bits and a first saturation threshold i, a quantity k of subbands to be encoded, where i is a positive number, and k is a positive integer. According to the quantity k of subbands that is determined by the determining unit 510, the selecting unit 520 selects, according to quantized envelopes of all subbands, k subbands from all the subbands, or selects k subbands from all subbands according to a psychoacoustic model. The encoding unit 530 performs a first-time encoding operation on spectral coefficients of the k subbands selected by the selecting unit 520.

In this embodiment of the present disclosure, a quantity k of subbands to be encoded is determined according to a quantity of available bits and a first saturation threshold, and encoding is performed on k subbands that are selected from all subbands, instead of on an entire frequency band, which can reduce spectrum holes of a signal obtained through decoding, and therefore, can improve auditory quality of an output signal.

Optionally, as an embodiment, the encoding unit 530 may normalize the spectral coefficients of the k subbands, to obtain normalized spectral coefficients of the k subbands, and quantize the normalized spectral coefficients of the k subbands, to obtain quantized spectral coefficients of the k subbands.

Optionally, as another embodiment, if a quantity of remaining bits in the quantity of available bits is greater than or equal to a first bit quantity threshold after the first-time encoding operation, the selecting unit 520 may further determine, according to the quantity of remaining bits, a second saturation threshold j, and the quantized spectral coefficients of the k subbands, m vectors on which second-time encoding is to be performed, where j is a positive number, and m is a positive integer. The encoding unit 530 may further perform a second-time encoding operation on spectral coefficients of the m vectors determined by the selecting unit 520.

Optionally, as another embodiment, the selecting unit 520 may determine, according to the quantity of remaining bits and a second saturation threshold j, a quantity m of vectors to be encoded; determine candidate spectral coefficients according to the quantized spectral coefficients of the k subbands; and select the m vectors from vectors to which the candidate spectral coefficients belong, where the candidate spectral coefficients may include spectral coefficients that are obtained by subtracting the corresponding quantized spectral coefficients of the k subbands from the normalized spectral coefficients of the k subbands.

Optionally, as another embodiment, the selecting unit 520 may sort the vectors to which the candidate spectral coefficients belong, to obtain sorted vectors. The selecting unit 520 may select the first m vectors from the sorted vectors, where the sorted vectors are divided into a first group of vectors and a second group of vectors, the first group of vectors are arranged before the second group of vectors, the first group of vectors correspond to vectors whose values are all 0s in vectors to which the quantized spectral coefficients of the k subbands belong, and the second group of vectors correspond to vectors whose values are not all 0s in the vectors to which the quantized spectral coefficients of the k subbands belong.

Optionally, as another embodiment, in each group of vectors of the first group of vectors and the second group of vectors, vectors in different subbands may be arranged in ascending order of frequencies of the subbands in which the vectors are located, and vectors in a same subband may be arranged in an original order of the vectors.

Optionally, as another embodiment, in each group of vectors of the first group of vectors and the second group of vectors, vectors in different subbands are arranged in descending order of quantized envelopes of the subbands in which the vectors are located, and vectors in a same subband are arranged in an original order of the vectors.

Optionally, as another embodiment, the selecting unit 520 may select, in descending order of quantized envelopes of subbands in which the vectors to which the candidate spectral coefficients belong are located, the m vectors from the vectors to which the candidate spectral coefficients belong.

Optionally, as another embodiment, the encoding unit 530 may determine global gains of the spectral coefficients of the m vectors; normalize the spectral coefficients of the m vectors by using the global gains of the spectral coefficients of the m vectors; and quantize normalized spectral coefficients of the m vectors.

Optionally, as another embodiment, the encoding unit 530 may determine global gains of spectral coefficients of the first group of vectors and global gains of spectral coefficients of the second group of vectors; normalize spectral coefficients of vectors that belong to the first group of vectors and are in the m vectors by using the global gains of the spectral coefficients of the first group of vectors, and normalize spectral coefficients of vectors that belong to the second group of vectors and are in the m vectors by using the global gains of the spectral coefficients of the second group of vectors; and quantize normalized spectral coefficients of the m vectors.

Optionally, as another embodiment, the selecting unit 520 may determine m according to the equation (2).

Optionally, as another embodiment, the determining unit 510 may determine k according to the equation (1).

Optionally, as another embodiment, if a signal is a transient signal, a fricative signal, or a long pitch signal, the determining unit 510 may determine, according to the quantity of available bits and the first saturation threshold i, the quantity k of subbands to be encoded.

For other functions and operations of the device 500 of FIG. 5, refer to processes involving the encoding end in the foregoing method embodiments of FIG. 1, FIG. 3, and FIG. 4. To avoid repetition, details are not described herein again.

Figure 6:
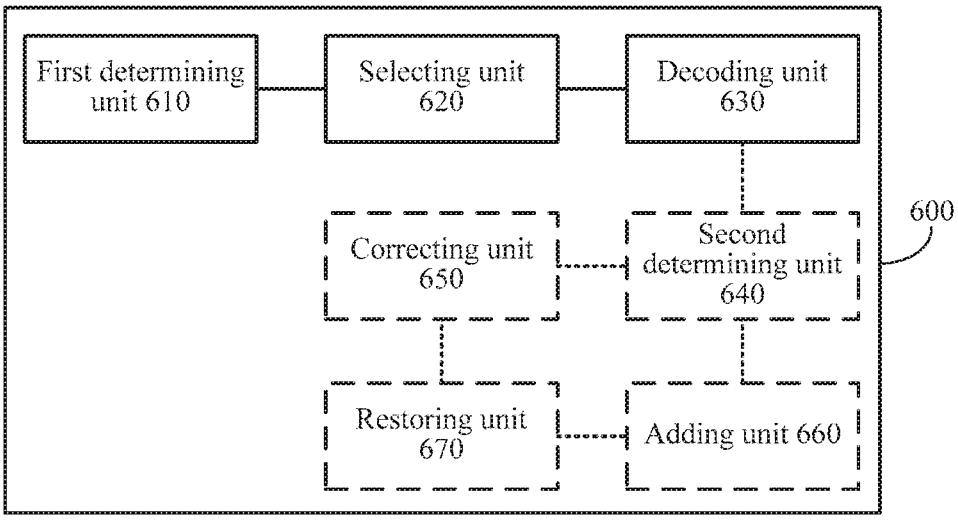
FIG. 6 is a schematic block diagram of a signal decoding device according to an embodiment of the present disclosure.

FIG. 6 is a schematic block diagram of a signal decoding device according to an embodiment of the present disclosure. For example, a device 600 of FIG. 6 is a speech decoder or an audio decoder. The device 600 includes a first determining unit 610, a selecting unit 620, and a decoding unit 630.

The first determining unit 610 determines, according to a quantity of available bits and a first saturation threshold i, a quantity k of subbands to be decoded, where i is a positive number, and k is a positive integer. According to the quantity k of subbands that is determined by the first determining unit 610, the selecting unit 620 selects, according to decoded envelopes of all subbands, k subbands from all the subbands, or selects k subbands from all subbands according to a psychoacoustic model. The decoding unit 630 performs a first-time decoding operation, to obtain quantized spectral coefficients of the k subbands selected by the selecting unit 620.

In this embodiment of the present disclosure, a quantity k of subbands to be decoded is determined according to a quantity of available bits and a first saturation threshold, and decoding is performed on k subbands that are selected from all subbands, which can reduce spectrum holes of a signal obtained through decoding, and therefore, can improve auditory quality of an output signal.

Optionally, as another embodiment, if a quantity of remaining bits in the quantity of available bits is greater than or equal to a first bit quantity threshold after the first-time decoding operation, the first determining unit 610 may further determine, according to the quantity of remaining bits and a second saturation threshold j, a quantity m of vectors on which second-time decoding is to be performed, where j is a positive number, and m is a positive integer. The decoding unit 630 may further perform a second-time decoding operation, to obtain normalized spectral coefficients of the m vectors.

Optionally, as another embodiment, the device 600 may further include a second determining unit 640. The second determining unit 640 may determine a correspondence between the normalized spectral coefficients of the m vectors and the quantized spectral coefficients of the k subbands.

Optionally, as another embodiment, the second determining unit 640 may determine a correspondence between the m vectors and a first type of vectors in vectors to which the quantized spectral coefficients of the k subbands belong, where the m vectors are in a one-to-one correspondence with the first type of vectors.

Optionally, as another embodiment, the second determining unit 640 may sort the vectors to which the quantized spectral coefficients of the k subbands belong, to obtain sorted vectors; select the first m vectors from the sorted vectors as the first type of vectors; and establish a correspondence between the first type of vectors and the m vectors, where the sorted vectors are divided into a first group of vectors and a second group of vectors, the first group of vectors are arranged before the second group of vectors, the first group of vectors include vectors whose values are all 0s in vectors to which a first group of decoded spectral coefficients belong, and the second group of vectors include vectors whose values are not all 0s in the vectors to which the first group of decoded spectral coefficients belong.

Optionally, as another embodiment, in each group of vectors of the first group of vectors and the second group of vectors, vectors in different subbands are arranged in ascending order of frequencies of the subbands in which the vectors are located, and vectors in a same subband are arranged in an original order of the vectors.

Optionally, as another embodiment, in each group of vectors of the first group of vectors and the second group of vectors, vectors in different subbands are arranged in descending order of quantized envelopes of the subbands in which the vectors are located, and vectors in a same subband are arranged in an original order of the vectors.

Optionally, as another embodiment, the second determining unit 640 may select, in descending order of quantized envelopes of subbands in which the vectors to which the quantized spectral coefficients of the k subbands belong are located, m vectors from the vectors to which the quantized spectral coefficients of the k subbands belong as the first type of vectors; and establish a correspondence between the first type of vectors and the m vectors.

Optionally, as another embodiment, the device 600 may further include a correcting unit 650.

The decoding unit 630 may decode global gains of the m vectors.

The correcting unit 650 may correct the normalized spectral coefficients of the m vectors by using the global gains of the m vectors, to obtain spectral coefficients of the m vectors.

Optionally, as another embodiment, the decoding unit 630 may decode a first global gain and a second global gain.

The correcting unit 650 may correct, by using the first global gain, spectral coefficients that correspond to the first group of vectors and are in the normalized spectral coefficients of the m vectors, and correct, by using the second global gain, spectral coefficients that correspond to the second group of vectors and are in the normalized spectral coefficients of the m vectors, to obtain spectral coefficients of the m vectors.

Optionally, as another embodiment, the device 600 may further include an adding unit 660 and a restoring unit 670. The adding unit 660 may add together the quantized spectral coefficients of the k subbands and the spectral coefficients of the m vectors, to obtain normalized spectral coefficients of the k subbands. The restoring unit 670 may perform noise filling on a spectral coefficient whose value is 0 in the normalized spectral coefficients of the k subbands, and restore a spectral coefficient of another subband in all the subbands except the k subbands, to obtain spectral coefficients of a first frequency band, where the first frequency band includes all the subbands. The correcting unit 650 may correct the spectral coefficients of the first frequency band by using the envelopes of all the subbands, to obtain normalized spectral coefficients of the first frequency band. The correcting unit 650 may further correct the normalized spectral coefficients of the first frequency band by using a global gain of the first frequency band, to obtain a final frequency domain signal of the first frequency band.

Optionally, as another embodiment, the restoring unit 670 may determine a weighted value according to core layer decoding information; and weight spectral coefficients that are adjacent to the spectral coefficient whose value is 0 in the normalized spectral coefficients of the k subbands and random noise by using the weighted value.

Optionally, as another embodiment, the restoring unit 670 may acquire signal classification information from the core layer decoding information; and if the signal classification information indicates that a signal is a fricative signal, the restoring unit 670 may acquire a predetermined weighted value; or if the signal classification information indicates that a signal is another signal except a fricative signal, the restoring unit 670 may acquire a pitch period from the core layer decoding information, and determine the weighted value according to the pitch period.

Optionally, as another embodiment, the restoring unit 670 may select, from all the subbands, n subbands that are adjacent to the another subband, and restore the spectral coefficient of the another subband according to spectral coefficients of the n subbands, where n is a positive integer; or the restoring unit 670 may select p subbands from the k subbands, and restore the spectral coefficient of the another subband according to spectral coefficients of the p subbands, where a quantity of bits allocated to each subband in the p subbands is greater than or equal to a second bit quantity threshold, where p is a positive integer.

Optionally, as another embodiment, the first determining unit 610 may determine m according to the following equation (2).

Optionally, as another embodiment, the first determining unit 610 may determine k according to the following equation (1).

Optionally, as another embodiment, if a signal is a transient signal, a fricative signal, or a long pitch signal, the first determining unit 610 may determine, according to the quantity of available bits and the first saturation threshold i, the quantity k of subbands to be decoded.

For other functions and operations of the device 600 of FIG. 6, refer to processes involving the encoding end in the foregoing method embodiment of FIG. 2. To avoid repetition, details are not described herein again.

Figure 7:
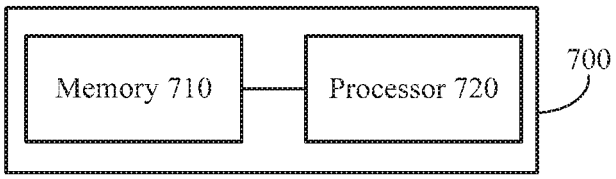
FIG. 7 is a schematic block diagram of a signal encoding device according to another embodiment of the present disclosure.

FIG. 7 is a schematic block diagram of a signal encoding device according to another embodiment of the present disclosure. For example, a device 700 of FIG. 7 is a speech encoder or an audio encoder. The device 700 includes a memory 710 and a processor 720.

The memory 710 may include a random access memory, a flash memory, a read-only memory, a programmable read-only memory, a non-volatile memory, a register, or the like. The processor 720 may be a central processing unit (Central Processing Unit, CPU).

The memory 710 is configured to store an executable instruction. The processor 720 may execute the executable instruction stored in the memory 710, and is configured to determine, according to a quantity of available bits and a first saturation threshold i, a quantity k of subbands to be encoded, where i is a positive number, and k is a positive integer; select, according to quantized envelopes of all subbands, k subbands from all the subbands, or select k subbands from all subbands according to a psychoacoustic model; and perform a first-time encoding operation on spectral coefficients of the k subbands.

In this embodiment of the present disclosure, a quantity k of subbands to be encoded is determined according to a quantity of available bits and a first saturation threshold, and encoding is performed on k subbands that are selected from all subbands, instead of on an entire frequency band, which can reduce spectrum holes of a signal obtained through decoding, and therefore, can improve auditory quality of an output signal.

Optionally, as an embodiment, the processor 720 may normalize the spectral coefficients of the k subbands, to obtain normalized spectral coefficients of k subbands, and quantize the normalized spectral coefficients of k subbands, to obtain quantized spectral coefficients of k subbands.

Optionally, as another embodiment, if a quantity of remaining bits in the quantity of available bits is greater than or equal to a first bit quantity threshold after the first-time encoding, the processor 720 may further determine, according to the quantity of remaining bits, a second saturation threshold j, and the quantized spectral coefficients of the k subbands, m vectors on which second-time encoding is to be performed, where j is a positive number, and m is a positive integer. The processor 720 may further perform a second-time encoding operation on spectral coefficients of the m vectors.

Optionally, as another embodiment, the processor 720 may determine, according to the quantity of remaining bits and the second saturation threshold j, a quantity m of vectors to be encoded; determine candidate spectral coefficients according to the quantized spectral coefficients of the k subbands; and select m vectors from vectors to which the candidate spectral coefficients belong, where the candidate spectral coefficients may include spectral coefficients that are obtained by subtracting the corresponding quantized spectral coefficients of the k subbands from the normalized spectral coefficients of the k subbands.

Optionally, as another embodiment, the processor 720 may sort the vectors to which the candidate spectral coefficients belong, to obtain sorted vectors; and select the first m vectors from the sorted vectors, where the sorted vectors are divided into a first group of vectors and a second group of vectors, the first group of vectors are arranged before the second group of vectors, the first group of vectors correspond to vectors whose values are all 0s in vectors to which the quantized spectral coefficients of the k subbands belong, and the second group of vectors correspond to vectors whose values are not all 0s in the vectors to which the quantized spectral coefficients of the k subbands belong.

Optionally, as another embodiment, in each group of vectors of the first group of vectors and the second group of vectors, vectors in different subbands may be arranged in ascending order of frequencies of the subbands in which the vectors are located, and vectors in a same subband may be arranged in an original order of the vectors.

Optionally, as another embodiment, in each group of vectors of the first group of vectors and the second group of vectors, vectors in different subbands are arranged in descending order of quantized envelopes of the subbands in which the vectors are located, and vectors in a same subband are arranged in an original order of the vectors.

Optionally, as another embodiment, the processor 720 may select, in descending order of quantized envelopes of subbands in which the vectors to which the candidate spectral coefficients belong are located, the m vectors from the vectors to which the candidate spectral coefficients belong.

Optionally, as another embodiment, the processor 720 may determine global gains of the spectral coefficients of the m vectors; normalize the spectral coefficients of the m vectors by using the global gains of the spectral coefficients of the m vectors; and quantize normalized spectral coefficients of the m vectors.

Optionally, as another embodiment, the processor 720 may determine global gains of spectral coefficients of the first group of vectors and global gains of spectral coefficients of the second group of vectors; normalize spectral coefficients of vectors that belong to the first group of vectors and are in the m vectors by using the global gains of the spectral coefficients of the first group of vectors, and normalize spectral coefficients of vectors that belong to the second group of vectors and are in the m vectors by using the global gains of the spectral coefficients of the second group of vectors; and quantize normalized spectral coefficients of the m vectors.

Optionally, as another embodiment, the processor 720 may determine m according to the equation (2).

Optionally, as another embodiment, the processor 720 may determine k according to the equation (1).

Optionally, as another embodiment, if a signal is a transient signal, a fricative signal, or a long pitch signal, the processor 720 may determine, according to the quantity of available bits and the first saturation threshold i, the quantity k of subbands to be encoded.

For other functions and operations of the device 700 of FIG. 7, refer to processes involving the encoding end in the foregoing method embodiments of FIG. 1, FIG. 3, and FIG. 4. To avoid repetition, details are not described herein again.

Figure 8:
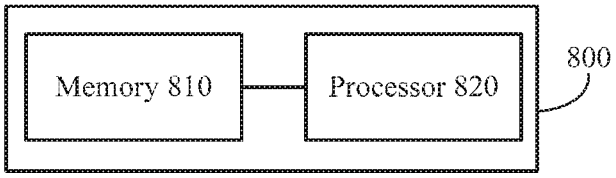
FIG. 8 is a schematic block diagram of a signal decoding device according to another embodiment of the present disclosure.

FIG. 8 is a schematic block diagram of a signal decoding device according to another embodiment of the present disclosure. For example, a device 800 of FIG. 8 is a speech decoder or an audio decoder. The device 800 includes a memory 810 and a processor 820.

The memory 810 may include a random access memory, a flash memory, a read-only memory, a programmable read-only memory, a non-volatile memory, a register, or the like. The processor 820 may be a central processing unit (Central Processing Unit, CPU).

The memory 810 is configured to store an executable instruction. The processor 820 may execute the executable instruction stored in the memory 810, and is configured to determine, according to a quantity of available bits and a first saturation threshold i, a quantity k of subbands to be decoded, where i is a positive number, and k is a positive integer; according to the quantity k of subbands, select, according to decoded envelopes of all subbands, k subbands from all the subbands, or select k subbands from all subbands according to a psychoacoustic model; and perform a first-time decoding operation, to obtain quantized spectral coefficients of the k subbands.

In this embodiment of the present disclosure, a quantity k of subbands to be decoded is determined according to a quantity of available bits and a first saturation threshold, and decoding is performed on k subbands that are selected from all subbands, which can reduce spectrum holes of a signal obtained through decoding, and therefore, can improve auditory quality of an output signal.

Optionally, as another embodiment, if a quantity of remaining bits in the quantity of available bits is greater than or equal to a first bit quantity threshold after the first-time decoding operation, the processor 820 may further determine, according to the quantity of remaining bits and a second saturation threshold j, a quantity m of vectors on which second-time decoding is to be performed, where j is a positive number, and m is a positive integer. The processor 820 may further perform a second-time decoding operation, to obtain normalized spectral coefficients of the m vectors.

Optionally, as another embodiment, the processor 820 may determine a correspondence between the normalized spectral coefficients of the m vectors and the quantized spectral coefficients of the k subbands.

Optionally, as another embodiment, the processor 820 may determine a correspondence between the m vectors and a first type of vectors in vectors to which the quantized spectral coefficients of the k subbands belong, where the m vectors are in a one-to-one correspondence with the first type of vectors.

Optionally, as another embodiment, the processor 820 may sort the vectors to which the quantized spectral coefficients of the k subbands belong, to obtain sorted vectors; may select the first m vectors from the sorted vectors as the first type of vectors; and may establish a correspondence between the first type of vectors and the m vectors, where the sorted vectors are divided into a first group of vectors and a second group of vectors, the first group of vectors are arranged before the second group of vectors, the first group of vectors include vectors whose values are all 0s in vectors to which a first group of decoded spectral coefficients belong, and the second group of vectors include vectors whose values are not all 0s in the vectors to which the first group of decoded spectral coefficients belong.

Optionally, as another embodiment, in each group of vectors of the first group of vectors and the second group of vectors, vectors in different subbands are arranged in ascending order of frequencies of the subbands in which the vectors are located, and vectors in a same subband are arranged in an original order of the vectors.

Optionally, as another embodiment, in each group of vectors of the first group of vectors and the second group of vectors, vectors in different subbands are arranged in descending order of quantized envelopes of the subbands in which the vectors are located, and vectors in a same subband are arranged in an original order of the vectors.

Optionally, as another embodiment, the processor 820 may select, in descending order of quantized envelopes of subbands in which the vectors to which the quantized spectral coefficients of the k subbands belong are located, m vectors from the vectors to which the quantized spectral coefficients of the k subbands belong as the first type of vectors; and establish a correspondence between the first type of vectors and the m vectors.

Optionally, as another embodiment, the processor 820 may decode global gains of the m vectors; and correct the normalized spectral coefficients of the m vectors by using the global gains of the m vectors, to obtain spectral coefficients of the m vectors.

Optionally, as another embodiment, the processor 820 may decode a first global gain and a second global gain; and correct, by using the first global gain, spectral coefficients that correspond to the first group of vectors and are in the normalized spectral coefficients of the m vectors, and correct, by using the second global gain, spectral coefficients that correspond to the second group of vectors and are in the normalized spectral coefficients of the m vectors, to obtain spectral coefficients of the m vectors.

Optionally, as another embodiment, the processor 820 may add together the quantized spectral coefficients of the k subbands and the spectral coefficients of the m vectors, to obtain normalized spectral coefficients of the k subbands. The processor 820 may perform noise filling on a spectral coefficient whose value is 0 in the normalized spectral coefficients of the k subbands, and restore a spectral coefficient of another subband in all the subbands except the k subbands, to obtain spectral coefficients of a first frequency band, where the first frequency band includes all the subbands. The processor 820 may correct the spectral coefficients of the first frequency band by using the envelopes of all the subbands, to obtain normalized spectral coefficients of the first frequency band. The processor 820 may further correct the normalized spectral coefficients of the first frequency band by using a global gain of the first frequency band, to obtain a final frequency domain signal of the first frequency band.

Optionally, as another embodiment, the processor 820 may determine a weighted value according to core layer decoding information; and weight spectral coefficients that are adjacent to the spectral coefficient whose value is 0 in the normalized spectral coefficients of the k subbands and random noise by using the weighted value.

Optionally, as another embodiment, the processor 820 may acquire signal classification information from the core layer decoding information; and if the signal classification information indicates that a signal is a fricative signal, the processor 820 may acquire a predetermined weighted value; or if the signal classification information indicates that a signal is another signal except a fricative signal, the processor 820 may acquire a pitch period from the core layer decoding information, and determine the weighted value according to the pitch period.

Optionally, as another embodiment, the processor 820 may select, from all the subbands, n subbands that are adjacent to the another subband, and restore the spectral coefficient of the another subband according to spectral coefficients of the n subbands, where n is a positive integer; or the processor 820 may select p subbands from the k subbands, and restore the spectral coefficient of the another subband according to spectral coefficients of the p subbands, where a quantity of bits allocated to each subband in the p subbands is greater than or equal to a second bit quantity threshold, where p is a positive integer.

Optionally, as another embodiment, the processor 820 may determine m according to the equation (2).

Optionally, as another embodiment, the processor 820 may determine k according to the equation (1).

Optionally, as another embodiment, if a signal is a transient signal, a fricative signal, or a long pitch signal, the processor 820 may determine, according to the quantity of available bits and the first saturation threshold i, the quantity k of subbands to be decoded.

For other functions and operations of the device 800 of FIG. 8, refer to processes involving the encoding end in the foregoing method embodiment of FIG. 2. To avoid repetition, details are not described herein again.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of the present disclosure.

It may be clearly understood by a person skilled in the art that, for the purpose of convenient and brief description, for a detailed working process of the foregoing system, apparatus, and unit, refer to a corresponding process in the foregoing method embodiments, and details are not described herein again.

In the several embodiments provided in this application, it should be understood that the disclosed system, apparatus, and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments.

In addition, functional units in the embodiments of the present disclosure may be integrated into one processing unit, or each of the units may exist alone physically, or two or more units are integrated into one unit.

When the functions are implemented in the form of a software functional unit and sold or used as an independent product, the functions may be stored in a computer-readable storage medium. Based on such an understanding, the technical solutions of the present disclosure essentially, or the part contributing to the prior art, or some of the technical solutions may be implemented in a form of a software product. The computer software product is stored in a storage medium, and includes several instructions for instructing a computer device (which may be a personal computer, a server, or a network device) to perform all or some of the steps of the methods described in the embodiments of the present disclosure. The foregoing storage medium includes: any medium that can store program code, such as a USB flash drive, a removable hard disk, a read-only memory (ROM, Read-Only Memory), a random access memory (RAM, Random Access Memory), a magnetic disk, or an optical disc.

According to a first aspect of the present disclosure, a signal encoding method is provided, where the method includes: determining, according to a quantity of available bits and a first saturation threshold i, a quantity k of subbands to be encoded, where i is a positive number, and k is a positive integer; selecting, according to quantized envelopes of all subbands, k subbands from all the subbands, or selecting k subbands from all the subbands according to a psychoacoustic model; and performing a first-time encoding operation on spectral coefficients of the k subbands.

With reference to the first aspect of the present disclosure, in a first possible implementation manner, the performing a first-time encoding operation on spectral coefficients of the k subbands includes: normalizing the spectral coefficients of the k subbands, to obtain normalized spectral coefficients of the k subbands; and quantizing the normalized spectral coefficients of the k subbands, to obtain quantized spectral coefficients of the k subbands.

With reference to the first possible implementation manner of the first aspect of the present disclosure, in a second possible implementation manner, the method further includes: if a quantity of remaining bits in the quantity of available bits is greater than or equal to a first bit quantity threshold after the first-time encoding operation, determining, according to the quantity of remaining bits, a second saturation threshold j, and the quantized spectral coefficients of the k subbands, m vectors on which second-time encoding is to be performed, where j is a positive number, and m is a positive integer; and performing a second-time encoding operation on spectral coefficients of the m vectors.

With reference to the second possible implementation manner of the first aspect of the present disclosure, in a third possible implementation manner, the determining, according to the quantity of remaining bits, a second saturation threshold j, and the quantized spectral coefficients of the k subbands, m vectors on which second-time encoding is to be performed includes: determining, according to the quantity of remaining bits and the second saturation threshold j, a quantity m of vectors on which second-time encoding is to be performed; determining candidate spectral coefficients according to the quantized spectral coefficients of the k subbands, where the candidate spectral coefficients include spectral coefficients that are obtained by subtracting the corresponding quantized spectral coefficients of the k subbands from the normalized spectral coefficients of the k subbands; and selecting the m vectors from vectors to which the candidate spectral coefficients belong.

With reference to the third possible implementation manner of the first aspect of the present disclosure, in a fourth possible implementation manner, the selecting the m vectors from vectors to which the candidate spectral coefficients belong includes: sorting the vectors to which the candidate spectral coefficients belong, to obtain sorted vectors; and selecting the first m vectors from the sorted vectors, where the sorted vectors are divided into a first group of vectors and a second group of vectors, the first group of vectors are arranged before the second group of vectors, the first group of vectors correspond to vectors whose values are all 0s in vectors to which the quantized spectral coefficients of the k subbands belong, and the second group of vectors correspond to vectors whose values are not all 0s in the vectors to which the quantized spectral coefficients of the k subbands belong.

With reference to the fourth possible implementation manner of the first aspect of the present disclosure, in a fifth possible implementation manner, in each group of vectors of the first group of vectors and the second group of vectors, vectors in different subbands are arranged in ascending order of frequencies of the subbands in which the vectors are located, and vectors in a same subband are arranged in an original order of the vectors.

With reference to the fourth possible implementation manner of the first aspect of the present disclosure, in a sixth possible implementation manner, in each group of vectors of the first group of vectors and the second group of vectors, vectors in different subbands are arranged in descending order of quantized envelopes of the subbands in which the vectors are located, and vectors in a same subband are arranged in an original order of the vectors.

With reference to the third possible implementation manner of the first aspect of the present disclosure, in a seventh possible implementation manner, the selecting the m vectors from vectors to which the candidate spectral coefficients belong includes: selecting, in descending order of quantized envelopes of subbands in which the vectors to which the candidate spectral coefficients belong are located, the m vectors from the vectors to which the candidate spectral coefficients belong.

With reference to any possible implementation manner of the second possible implementation manner to the seventh possible implementation manner of the first aspect of the present disclosure, in an eighth possible implementation manner, the performing a second-time encoding operation on spectral coefficients of the m vectors includes: determining global gains of the spectral coefficients of the m vectors; normalizing the spectral coefficients of the m vectors by using the global gains of the spectral coefficients of the m vectors; and quantizing normalized spectral coefficients of the m vectors.

With reference to any possible implementation manner of the fourth possible implementation manner to the sixth possible implementation manner of the first aspect of the present disclosure, in a ninth possible implementation manner, the performing a second-time encoding operation on spectral coefficients of the m vectors includes: determining global gains of spectral coefficients of the first group of vectors and global gains of spectral coefficients of the second group of vectors; normalizing spectral coefficients of vectors that belong to the first group of vectors and are in the m vectors by using the global gains of the spectral coefficients of the first group of vectors, and normalizing spectral coefficients of vectors that belong to the second group of vectors and are in the m vectors by using the global gains of the spectral coefficients of the second group of vectors; and quantizing normalized spectral coefficients of the m vectors.

With reference to any possible implementation manner of the third possible implementation manner to the ninth possible implementation manner of the first aspect of the present disclosure, in a tenth possible implementation manner, the determining, according to the quantity of remaining bits and the second saturation threshold j, a quantity m of vectors to be encoded includes: determining m according to the following equation: $m=\lfloor C/(j\times M)+0.5\rfloor$, where C indicates a quantity of remaining bits, and M indicates a quantity of spectral coefficients included in each vector.

With reference to the first aspect or any possible implementation manner of the first possible implementation manner to the tenth possible implementation manner of the first aspect of the present disclosure, in an eleventh possible implementation manner, the determining, according to a quantity of available bits and a first saturation threshold i, a quantity k of subbands to be encoded includes: determining k according to the following equation: $k=\lfloor B/(i\times L)+0.5\rfloor$, where B indicates a quantity of available bits, and L indicates a quantity of spectral coefficients included in each subband.

With reference to the first aspect or any possible implementation manner of the first possible implementation manner to the eleventh possible implementation manner of the first aspect of the present disclosure, in a twelfth possible implementation manner, the determining, according to a quantity of available bits and a first saturation threshold i, a quantity k of subbands to be encoded includes: if a signal is a transient signal, a fricative signal, or a long pitch signal, determining, according to the quantity of available bits and the first saturation threshold i, the quantity k of subbands to be encoded.

According to a second aspect of the present disclosure, a signal decoding method is provided, where the method includes: determining, according to a quantity of available bits and a first saturation threshold i, a quantity k of subbands to be decoded, where i is a positive number, and k is a positive integer; selecting, according to decoded envelopes of all subbands, k subbands from all the subbands, or selecting k subbands from all the subbands according to a psychoacoustic model; and performing a first-time decoding operation, to obtain quantized spectral coefficients of the k subbands.

With reference to the second aspect of the present disclosure, in a first possible implementation manner, the method further includes: if a quantity of remaining bits in the quantity of available bits is greater than or equal to a first bit quantity threshold after the first-time decoding operation, determining, according to the quantity of remaining bits and a second saturation threshold j, a quantity m of vectors on which second-time decoding is to be performed, where j is a positive number, and m is a positive integer; and performing a second-time decoding operation, to obtain normalized spectral coefficients of the m vectors.

With reference to the first possible implementation manner of the second aspect of the present disclosure, in a second possible implementation manner, the method further includes: determining a correspondence between the normalized spectral coefficients of the m vectors and the quantized spectral coefficients of the k subbands.

With reference to the second possible implementation manner of the second aspect of the present disclosure, in a third possible implementation manner, the determining a correspondence between the normalized spectral coefficients of the m vectors and the quantized spectral coefficients of the k subbands includes: determining a correspondence between the m vectors and a first type of vectors in vectors to which the quantized spectral coefficients of the k subbands belong, where the m vectors are in a one-to-one correspondence with the first type of vectors.

With reference to the third possible implementation manner of the second aspect of the present disclosure, in a fourth possible implementation manner, the determining a correspondence between the m vectors and a first type of vectors in vectors to which the quantized spectral coefficients of the k subbands belong includes: sorting the vectors to which the quantized spectral coefficients of the k subbands belong, to obtain sorted vectors, where the sorted vectors are divided into a first group of vectors and a second group of vectors, the first group of vectors are arranged before the second group of vectors, the first group of vectors include vectors whose values are all 0s in vectors to which the first group of decoded spectral coefficients belong, and the second group of vectors include vectors whose values are not all 0s in the vectors to which the first group of decoded spectral coefficients belong; selecting the first m vectors from the sorted vectors as the first type of vectors; and establishing a correspondence between the first type of vectors and the m vectors.

With reference to the fourth possible implementation manner of the second aspect of the present disclosure, in a fifth possible implementation manner, in each group of vectors of the first group of vectors and the second group of vectors, vectors in different subbands are arranged in ascending order of frequencies of the subbands in which the vectors are located, and vectors in a same subband are arranged in an original order of the vectors.

With reference to the fourth possible implementation manner of the second aspect of the present disclosure, in a sixth possible implementation manner, in each group of vectors of the first group of vectors and the second group of vectors, vectors in different subbands are arranged in descending order of quantized envelopes of the subbands in which the vectors are located, and vectors in a same subband are arranged in an original order of the vectors.

With reference to the third possible implementation manner of the second aspect of the present disclosure, in a seventh possible implementation manner, the determining a correspondence between the m vectors and a first type of vectors in vectors to which the quantized spectral coefficients of the k subbands belong includes: selecting, in descending order of quantized envelopes of subbands in which the vectors to which the quantized spectral coefficients of the k subbands belong are located, m vectors from the vectors to which the quantized spectral coefficients of the k subbands belong as the first type of vectors; and establishing a correspondence between the first type of vectors and the m vectors.

With reference to any implementation manner of the second possible implementation manner to the seventh possible implementation manner of the second aspect of the present disclosure, in an eighth possible implementation manner, the method further includes: decoding global gains of the m vectors; and correcting the normalized spectral coefficients of the m vectors by using the global gains of the m vectors, to obtain spectral coefficients of the m vectors.

With reference to any implementation manner of the fourth possible implementation manner to the sixth possible implementation manner of the second aspect of the present disclosure, in a ninth possible implementation manner, the method further includes: decode a first global gain and a second global gain; and correcting, by using the first global gain, spectral coefficients that correspond to the first group of vectors and are in the normalized spectral coefficients of the m vectors, and correcting, by using the second global gain, spectral coefficients that correspond to the second group of vectors and are in the normalized spectral coefficients of the m vectors, to obtain spectral coefficients of the m vectors.

With reference to the eighth possible implementation manner or the ninth possible implementation manner of the second aspect of the present disclosure, in a tenth possible implementation manner, the method further includes: adding together the quantized spectral coefficients of the k subbands and the spectral coefficients of the m vectors, to obtain normalized spectral coefficients of the k subbands; performing noise filling on a spectral coefficient whose value is 0 in the normalized spectral coefficients of the k subbands, and restoring a spectral coefficient of another subband in all the subbands except the k subbands, to obtain spectral coefficients of a first frequency band, where the first frequency band includes all the subbands; and correcting the spectral coefficients of the first frequency band by using the envelopes of all the subbands, to obtain normalized spectral coefficients of the first frequency band; and correcting the normalized spectral coefficients of the first frequency band by using a global gain of the first frequency band, to obtain a final frequency domain signal of the first frequency band.

With reference to the tenth possible implementation manner of the second aspect of the present disclosure, in an eleventh possible implementation manner, the adding together the quantized spectral coefficients of the k subbands and the spectral coefficients of the m vectors, to obtain normalized spectral coefficients of the k subbands includes: adding together the spectral coefficients of the m vectors and the quantized spectral coefficients of the k subbands according to a correspondence between the normalized spectral coefficients of the m vectors and the quantized spectral coefficients of the k subbands.

With reference to the tenth possible implementation manner or the eleventh possible implementation manner of the second aspect of the present disclosure, in a twelfth possible implementation manner, the performing noise filling on a spectral coefficient whose value is 0 in the normalized spectral coefficients of the k subbands includes: determining a weighted value according to core layer decoding information; and weighting spectral coefficients that are adjacent to the spectral coefficient whose value is 0 in the normalized spectral coefficients of the k subbands and random noise by using the weighted value.

With reference to the twelfth possible implementation manner of the second aspect of the present disclosure, in a thirteenth possible implementation manner, the determining a weighted value according to core layer decoding information includes: acquiring signal classification information from the core layer decoding information; and if the signal classification information indicates that a signal is a fricative signal, acquiring a predetermined weighted value; or if the signal classification information indicates that a signal is another signal except a fricative signal, acquiring a pitch period from the core layer decoding information, and determining a weighted value according to the pitch period.

With reference to any implementation manner of the tenth possible implementation manner to the thirteenth possible implementation manner of the second aspect of the present disclosure, in a fourteenth possible implementation manner, the restoring a spectral coefficient of another subband in all the subbands except the k subbands includes: selecting, from all the subbands, n subbands that are adjacent to the another subband except the k subbands, and restoring the spectral coefficient of the another subband except the k subbands according to spectral coefficients of the n subbands, where n is a positive integer; or selecting p subbands from the k subbands, and restoring the spectral coefficient of the another subband except the k subbands according to spectral coefficients of the p subbands, where a quantity of bits allocated to each subband in the p subbands is greater than or equal to a second bit quantity threshold, where p is a positive integer.

With reference to any implementation manner of the first possible implementation manner to the fourteenth possible implementation manner of the second aspect of the present disclosure, in a fifteenth possible implementation manner, the determining, according to the quantity of remaining bits and a second saturation threshold j, a quantity m of vectors on which second-time decoding is to be performed includes: determining m according to the following equation: $m=\lfloor C/(j\times M)+0.5\rfloor$, where C indicates a quantity of remaining bits, and M indicates a quantity of spectral coefficients included in each vector.

With reference to the second aspect of the present disclosure or any implementation manner of the first possible implementation manner to the fifteenth possible implementation manner of the second aspect, in a sixteenth possible implementation manner, the determining, according to a quantity of available bits and a first saturation threshold i, a quantity k of subbands to be decoded includes: determining k according to the following equation: $k=\lfloor B/(i\times L)+0.5\rfloor$, where B indicates a quantity of available bits, and L indicates a quantity of spectral coefficients included in each subband.

With reference to the second aspect of the present disclosure or any implementation manner of the first possible implementation manner to the sixteenth possible implementation manner of the second aspect, in a seventeenth possible implementation manner, the determining, according to a quantity of available bits and a first saturation threshold i, a quantity k of subbands to be decoded includes: if a signal is a transient signal, a fricative signal, or a long pitch signal, determining, according to the quantity of available bits and the first saturation threshold i, the quantity k of subbands to be decoded.

According to a third aspect of the present disclosure, a signal encoding device is provided, where the device includes: a determining unit, configured to determine, according to a quantity of available bits and a first saturation threshold i, a quantity k of subbands to be encoded, where i is a positive number, and k is a positive integer; a selecting unit, configured to: according to the quantity k of subbands that is determined by the determining unit, select, according to quantized envelopes of all subbands, k subbands from all the subbands, or select k subbands from all the subbands according to a psychoacoustic model; and an encoding unit, configured to perform a first-time encoding operation on spectral coefficients of the k subbands selected by the selecting unit.

With reference to the third aspect of the present disclosure, in a first possible implementation manner, the encoding unit is specifically configured to: normalize the spectral coefficients of the k subbands, to obtain normalized spectral coefficients of the k subbands; and quantize the normalized spectral coefficients of the k subbands, to obtain quantized spectral coefficients of the k subbands.

With reference to the first possible implementation manner of the third aspect of the present disclosure, in a second possible implementation manner, the selecting unit is further configured to: if a quantity of remaining bits in the quantity of available bits is greater than or equal to a first bit quantity threshold after the first-time encoding operation, determine, according to the quantity of remaining bits, a second saturation threshold j, and the quantized spectral coefficients of the k subbands, m vectors on which second-time encoding is to be performed, where j is a positive number, and m is a positive integer; and the encoding unit is further configured to perform a second-time encoding operation on spectral coefficients of the m vectors determined by the selecting unit.

With reference to the second possible implementation manner of the third aspect of the present disclosure, in a third possible implementation manner, the selecting unit is specifically configured to determine, according to the quantity of remaining bits and a second saturation threshold j, a quantity m of vectors to be encoded; determine candidate spectral coefficients according to the quantized spectral coefficients of the k subbands, where the candidate spectral coefficients include spectral coefficients that are obtained by subtracting the corresponding quantized spectral coefficients of the k subbands from the normalized spectral coefficients of the k subbands; and select the m vectors from vectors to which the candidate spectral coefficients belong.

With reference to the third possible implementation manner of the third aspect of the present disclosure, in a fourth possible implementation manner, the selecting unit is specifically configured to sort the vectors to which the candidate spectral coefficients belong, to obtain sorted vectors; and select the first m vectors from the sorted vectors; where the sorted vectors are divided into a first group of vectors and a second group of vectors, the first group of vectors are arranged before the second group of vectors, the first group of vectors correspond to vectors whose values are all 0s in vectors to which the quantized spectral coefficients of the k subbands belong, and the second group of vectors correspond to vectors whose values are not all 0s in the vectors to which the quantized spectral coefficients of the k subbands belong.

With reference to the third possible implementation manner of the third aspect of the present disclosure, in a fifth possible implementation manner, the selecting unit is specifically configured to select, in descending order of quantized envelopes of subbands in which the vectors to which the candidate spectral coefficients belong are located, the m vectors from the vectors to which the candidate spectral coefficients belong.

With reference to any implementation manner of the second possible implementation manner to the fifth possible implementation manner of the third aspect of the present disclosure, in a sixth possible implementation manner, the encoding unit is specifically configured to determine global gains of the spectral coefficients of the m vectors; normalize the spectral coefficients of the m vectors by using the global gains of the spectral coefficients of the m vectors; and quantize normalized spectral coefficients of the m vectors.

With reference to the fourth possible implementation manner of the third aspect of the present disclosure, in a seventh possible implementation manner, the encoding unit is specifically configured to determine global gains of spectral coefficients of the first group of vectors and global gains of spectral coefficients of the second group of vectors; normalize spectral coefficients of vectors that belong to the first group of vectors and are in the m vectors by using the global gains of the spectral coefficients of the first group of vectors, and normalize spectral coefficients of vectors that belong to the second group of vectors and are in the m vectors by using the global gains of the spectral coefficients of the second group of vectors; and quantize normalized spectral coefficients of the m vectors.

With reference to any implementation manner of the third possible implementation manner to the seventh possible implementation manner of the third aspect of the present disclosure, in an eighth possible implementation manner, the selecting unit is specifically configured to determine m according to the following equation: $m=\lfloor C/(j\times M)+0.5\rfloor$, where C indicates a quantity of remaining bits, and M indicates a quantity of spectral coefficients included in each vector.

With reference to the third aspect or any implementation manner of the first possible implementation manner to the eighth possible implementation manner of the third aspect of the present disclosure, in a ninth possible implementation manner, the determining unit is specifically configured to determine k according to the following equation: $k=\lfloor B/(i\times L)+0.5\rfloor$, where B indicates a quantity of available bits, and L indicates a quantity of spectral coefficients included in each subband.

With reference to the third aspect or any implementation manner of the first possible implementation manner to the ninth possible implementation manner of the third aspect of the present disclosure, in a tenth possible implementation manner, the determining unit is specifically configured to: if a signal is a transient signal, a fricative signal, or a long pitch signal, determine, according to the quantity of available bits and the first saturation threshold i, the quantity k of subbands to be encoded.

According to a fourth aspect of the present disclosure, a signal decoding device is provided, where the device includes: a first determining unit, configured to determine, according to a quantity of available bits and a first saturation threshold i, a quantity k of subbands to be decoded, where i is a positive number, and k is a positive integer; a selecting unit, configured to: according to the quantity k of subbands that is determined by the first determining unit, select, according to decoded envelopes of all subbands, k subbands from all the subbands, or select k subbands from all the subbands according to a psychoacoustic model; and a decoding unit, configured to perform a first-time decoding operation, to obtain quantized spectral coefficients of the k subbands selected by the selecting unit.

With reference to the fourth aspect of the present disclosure, in a first possible implementation manner, the first determining unit is further configured to: if a quantity of remaining bits in the quantity of available bits is greater than or equal to a first bit quantity threshold after the first-time decoding operation, determine, according to the quantity of remaining bits, a second saturation threshold j, and the first group of decoded spectral coefficients, a quantity m of vectors on which second-time decoding is to be performed, where j is a positive number, and m is a positive integer; and the decoding unit is further configured to perform a second-time decoding operation, to obtain normalized spectral coefficients of the m vectors.

With reference to the first possible implementation manner of the fourth aspect of the present disclosure, in a second possible implementation manner, the device further includes: a second determining unit, configured to determine a correspondence between the normalized spectral coefficients of the m vectors and the quantized spectral coefficients of the k subbands.

With reference to the second possible implementation manner of the fourth aspect of the present disclosure, in a third possible implementation manner, the second determining unit is specifically configured to determine a correspondence between the m vectors and a first type of vectors in vectors to which the quantized spectral coefficients of the k subbands belong, where the m vectors are in a one-to-one correspondence with the first type of vectors.

With reference to the third possible implementation manner of the fourth aspect of the present disclosure, in a fourth possible implementation manner, the second determining unit is specifically configured to sort the vectors to which the quantized spectral coefficients of the k subbands belong, to obtain sorted vectors, where the sorted vectors are divided into a first group of vectors and a second group of vectors, the first group of vectors are arranged before the second group of vectors, the first group of vectors include vectors whose values are all 0s in vectors to which the first group of decoded spectral coefficients belong, and the second group of vectors include vectors whose values are not all 0s in the vectors to which the first group of decoded spectral coefficients belong; select the first m vectors from the sorted vectors as the first type of vectors; and establish a correspondence between the first type of vectors and the m vectors.

With reference to the third possible implementation manner of the fourth aspect of the present disclosure, in a fifth possible implementation manner, the second determining unit is specifically configured to select, in descending order of quantized envelopes of subbands in which the vectors to which the quantized spectral coefficients of the k subbands belong are located, m vectors from the vectors to which the quantized spectral coefficients of the k subbands belong as the first type of vectors; and establish a correspondence between the first type of vectors and the m vectors.

With reference to any implementation manner of the first possible implementation manner to the fifth possible implementation manner of the fourth aspect of the present disclosure, in a sixth possible implementation manner, the device further includes: a correcting unit, where the decoding unit is further configured to decode global gains of the m vectors; and the correcting unit is configured to correct the normalized spectral coefficients of the m vectors by using the global gains of the m vectors, to obtain spectral coefficients of the m vectors.

With reference to the fourth possible implementation manner of the fourth aspect of the present disclosure, in a seventh possible implementation manner, the device further includes a correcting unit, where the decoding unit is further configured to decode a first global gain and a second global gain; and the correcting unit is configured to correct, by using the first global gain, spectral coefficients that correspond to the first group of vectors and are in the normalized spectral coefficients of the m vectors, and correct, by using the second global gain, spectral coefficients that correspond to the second group of vectors and are in the normalized spectral coefficients of the m vectors, to obtain spectral coefficients of the m vectors.

With reference to the sixth possible implementation manner or the seventh possible implementation manner of the fourth aspect of the present disclosure, in an eighth possible implementation manner, the device further includes an adding unit and a restoring unit, where the adding unit is configured to add together the quantized spectral coefficients of the k subbands and the spectral coefficients of the m vectors, to obtain spectral coefficients of the k subbands; the restoring unit is configured to perform noise filling on a spectral coefficient whose value is 0 in the normalized spectral coefficients of the k subbands, and restore a spectral coefficient of another subband in all the subbands except the k subbands, to obtain spectral coefficients of a first frequency band, where the first frequency band includes all the subbands; the correcting unit is further configured to correct the spectral coefficients of the first frequency band by using the envelopes of all the subbands, to obtain normalized spectral coefficients of the first frequency band; and the correcting unit is further configured to correct the normalized spectral coefficients of the first frequency band by using a global gain of the first frequency band, to obtain a final frequency domain signal of the first frequency band.

With reference to the eighth possible implementation manner of the fourth aspect of the present disclosure, in a ninth possible implementation manner, the adding unit is specifically configured to add together the spectral coefficients of the m vectors and the quantized spectral coefficients of the k subbands according to a correspondence between the normalized spectral coefficients of the m vectors and the quantized spectral coefficients of the k subbands.

With reference to the eighth possible implementation manner or the ninth possible implementation manner the fourth aspect of the present disclosure, in a tenth possible implementation manner, the restoring unit is specifically configured to determine a weighted value according to core layer decoding information; and weight spectral coefficients that are adjacent to the spectral coefficient whose value is 0 in the normalized spectral coefficients of the k subbands and random noise by using the weighted value.

With reference to the tenth possible implementation manner of the fourth aspect of the present disclosure, in an eleventh possible implementation manner, the restoring unit is specifically configured to acquire signal classification information from the core layer decoding information; and if the signal classification information indicates that a signal is a fricative signal, acquire a predetermined weighted value; or if the signal classification information indicates that a signal is another signal except a fricative signal, acquire a pitch period from the core layer decoding information, and determine a weighted value according to the pitch period.

With reference to any implementation manner of the eighth possible implementation manner to the eleventh possible implementation manner of the fourth aspect of the present disclosure, in a twelfth possible implementation manner, the restoring unit is specifically configured to select, from all the subbands, n subbands that are adjacent to the another subband except the k subbands, and restore the spectral coefficient of the another subband except the k subbands according to spectral coefficients of the n subbands, where n is a positive integer; or select p subbands from the k subbands, and restore the spectral coefficient of the another subband except the k subbands according to spectral coefficients of the p subbands, where a quantity of bits allocated to each subband in the p subbands is greater than or equal to a second bit quantity threshold, where p is a positive integer.

With reference to any implementation manner of the first possible implementation manner to the twelfth possible implementation manner of the fourth aspect of the present disclosure, in a thirteenth possible implementation manner, the first determining unit is specifically configured to determine m according to the following equation: $m=\lfloor C/(j\times M)+0.5\rfloor$, where C indicates a quantity of remaining bits, and M indicates a quantity of spectral coefficients included in each vector.

With reference to the fourth aspect or any implementation manner of the first possible implementation manner to the thirteenth possible implementation manner of the fourth aspect of the present disclosure, in a fourteenth possible implementation manner, the first determining unit is specifically configured to determine k according to the following equation: $k=\lfloor B/(i\times L)+0.5\rfloor$, where B indicates a quantity of available bits, and L indicates a quantity of spectral coefficients included in each subband.

With reference to the fourth aspect or any implementation manner of the first possible implementation manner to the fourteenth possible implementation manner of the fourth aspect, in a fifteenth possible implementation manner, the first determining unit is specifically configured to: if a signal is a transient signal, a fricative signal, or a long pitch signal, determine, according to the quantity of available bits and the first saturation threshold i, the quantity k of subbands to be decoded.

In the embodiments of the present disclosure, a quantity k of subbands to be encoded is determined according to a quantity of available bits and a first saturation threshold, and encoding is performed on k subbands that are selected from all subbands, instead of on an entire frequency band, which can reduce spectrum holes of a signal obtained through decoding, and therefore, can improve auditory quality of an output signal.

The foregoing descriptions are merely specific implementation manners of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. A signal encoding method, comprising:

obtaining, according to a time-frequency transformation, a frequency domain signal corresponding to an audio signal;

determining, a quantity k of subbands to be encoded, wherein k is a positive integer, k is 4 when a quantity of available bits is greater than 400, and k is 3 when the quantity of available bits is smaller than or equal to 400;

selecting, according to a quantized envelope of all subbands of the frequency domain signal, k subbands from all the subbands; and performing a first-time encoding operation on spectral coefficients of the k subbands.

2. The method according to claim 1, wherein the performing the first-time encoding operation on spectral coefficients of the k subbands comprises:

obtaining normalized spectral coefficients of the k subbands by normalizing the spectral coefficients of the k subbands; and obtaining quantized spectral coefficients of the k subbands by quantizing the normalized spectral coefficients of the k subbands.

3. The method according to claim 2, wherein the method further comprises:

if a quantity of remaining bits in the quantity of available bits is greater than or equal to a first bit quantity threshold after the first-time encoding operation, determining m vectors on which second-time encoding is to be performed according to the quantity of remaining bits, a second saturation threshold j, and the quantized spectral coefficients of the k subbands, wherein j is a positive number, and m is a positive integer; and performing a second-time encoding operation on spectral coefficients of the m vectors.

4. The method according to claim 3, wherein the determining m vectors on which second-time encoding is to be performed according to the quantity of remaining bits, a second saturation threshold j, and the quantized spectral coefficients of the k subbands comprises:

determining, according to the quantity of remaining bits and the second saturation threshold j, a quantity m of vectors on which second-time encoding is to be performed;

determining candidate spectral coefficients according to the quantized spectral coefficients of the k subbands, wherein the candidate spectral coefficients comprise spectral coefficients that are obtained by subtracting the corresponding quantized spectral coefficients of the k subbands from the normalized spectral coefficients of the k subbands; and selecting the m vectors from vectors to which the candidate spectral coefficients belong.

5. The method according to claim 4, wherein the selecting the m vectors from vectors to which the candidate spectral coefficients belong comprises:

obtaining sorted vectors by sorting the vectors to which the candidate spectral coefficients belong; and selecting the first m vectors from the sorted vectors, wherein:

the sorted vectors are divided into a first group of vectors and a second group of vectors, the first group of vectors are arranged before the second group of vectors, the first group of vectors correspond to vectors whose values are all 0s in vectors to which the quantized spectral coefficients of the k subbands belong, and the second group of vectors correspond to vectors whose values are not all 0s in the vectors to which the quantized spectral coefficients of the k subbands belong.

6. The method according to claim 3, wherein the performing a second-time encoding operation on spectral coefficients of the m vectors comprises:

determining global gains of the spectral coefficients of the m vectors;

normalizing the spectral coefficients of the m vectors by using the global gains of the spectral coefficients of the m vectors; and quantizing normalized spectral coefficients of the m vectors.

7. A signal decoding method, comprising:

determining a quantity k of subbands of an audio signal to be decoded, wherein k is a positive integer, k is 4 when a quantity of available bits is greater than 400, and k is 3 when the quantity of available bits is smaller than or equal to 400;

selecting, according to decoded envelopes of all subbands, k subbands from all the subbands;

obtaining quantized spectral coefficients of the k subbands by performing a first-time decoding operation; and obtaining, according to the quantized spectral coefficients of the k subbands, a frequency domain signal corresponding to the audio signal.

8. The method according to claim 7, wherein the method further comprises:

if a quantity of remaining bits in the quantity of available bits is greater than or equal to a first bit quantity threshold after the first-time decoding operation, determining, according to the quantity of remaining bits and a second saturation threshold j, a quantity m of vectors on which second-time decoding is to be performed, wherein j is a positive number, and m is a positive integer; and obtaining normalized spectral coefficients of the m vectors by performing a second-time decoding operation.

9. The method according to claim 8, wherein the method further comprises:

determining a correspondence between the normalized spectral coefficients of the m vectors and the quantized spectral coefficients of the k subbands.

10. A signal encoding device for encoding an audio signal, comprising:

at least one processor; and a non-transitory computer-readable storage medium coupled to the at least one processor and storing programming instructions for execution by the at least one processor, wherein the programming instructions instruct the at least one processor to:

obtain, according to a time-frequency transformation, a frequency domain signal corresponding to an audio signal;

determine a quantity k of subbands to be encoded, wherein k is a positive integer, k is 4 when a quantity of available bits is greater than 400, and k is 3 when the quantity of available bits is smaller than or equal to 400;

select, according to a quantized envelope of all subbands of the frequency domain signal, k subbands from all the subbands; and perform a first-time encoding operation on spectral coefficients of the k subbands.

11. The device according to claim 10, wherein the programming instructions instruct the at least one processor to:

obtain normalized spectral coefficients of the k subbands by normalizing the spectral coefficients of the k subbands; and obtain quantized spectral coefficients of the k subbands by quantizing the normalized spectral coefficients of the k subbands.

12. The device according to claim 11, wherein the programming instructions instruct the at least one processor to:

if a quantity of remaining bits in the quantity of available bits is greater than or equal to a first bit quantity threshold after the first-time encoding operation, determine m vectors on which second-time encoding is to be performed according to the quantity of remaining bits, a second saturation threshold j, and the quantized spectral coefficients of the k subbands, wherein j is a positive number, and m is a positive integer; and perform a second-time encoding operation on spectral coefficients of the m vectors.

13. The device according to claim 12, wherein the programming instructions instruct the at least one processor to:

determine, according to the quantity of remaining bits and the second saturation threshold j, a quantity m of vectors to be encoded;

determine candidate spectral coefficients according to the quantized spectral coefficients of the k subbands, wherein the candidate spectral coefficients comprise spectral coefficients that are obtained by subtracting the corresponding quantized spectral coefficients of the k subbands from the normalized spectral coefficients of the k subbands; and select the m vectors from vectors to which the candidate spectral coefficients belong.

14. The device according to claim 13, wherein programming instructions instruct the at least one processor to:

obtain sorted vectors by sorting the vectors to which the candidate spectral coefficients belong; and select the first m vectors from the sorted vectors, wherein the sorted vectors are divided into a first group of vectors and a second group of vectors, the first group of vectors are arranged before the second group of vectors, the first group of vectors correspond to vectors whose values are all 0s in vectors to which the quantized spectral coefficients of the k subbands belong, and the second group of vectors correspond to vectors whose values are not all 0s in the vectors to which the quantized spectral coefficients of the k subbands belong.

15. The device according to claim 10, wherein the programming instructions instruct the at least one processor to:

determine global gains of the spectral coefficients of the m vectors;

normalize the spectral coefficients of the m vectors by using the global gains of the spectral coefficients of the m vectors; and quantize normalized spectral coefficients of the m vectors.

16. A signal decoding device for decoding audio signal, comprising:

at least one processor;

a non-transitory computer-readable storage medium coupled to the at least one processor and storing programming instructions for execution by the at least one processor, wherein the programming instructions instruct the at least one processor to:

determine a quantity k of subbands to be decoded, wherein k is a positive integer, k is 4 when a quantity of available bits is greater than 400, and k is 3 when the quantity of available bits is smaller than or equal to 400;

select, according to decoded envelopes of all subbands, k subbands from all the subbands;

perform a first-time decoding operation, to obtain quantized spectral coefficients of the k subbands; and obtain, according to the quantized spectral coefficients of the k subbands, a frequency domain signal corresponding to the audio signal.

17. The device according to claim 16, wherein the programming instructions instruct the at least one processor to:

if a quantity of remaining bits in the quantity of available bits is greater than or equal to a first bit quantity threshold after the first-time decoding operation, determine a quantity m of vectors on which second-time decoding is to be performed according to the quantity of remaining bits, a second saturation threshold j, and a first group of decoded spectral coefficients, wherein j is a positive number, and m is a positive integer; and perform a second-time decoding operation, to obtain normalized spectral coefficients of the m vectors.

* * * * *